US011261408B2

(12) United States Patent
Kurth et al.

(10) Patent No.: US 11,261,408 B2
(45) Date of Patent: Mar. 1, 2022

(54) DETERGENT OR CLEANING AGENT HAVING AT LEAST TWO PHASES

(71) Applicant: Henkel AG & Co. KGaA, Duesseldorf (DE)

(72) Inventors: Oliver Kurth, Langenfeld (DE); Luca Bellomi, Duesseldorf (DE); Inga Kerstin Vockenroth, Duesseldorf (DE); Klaus Dorra, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 87 days.

(21) Appl. No.: 16/521,503

(22) Filed: Jul. 24, 2019

(65) Prior Publication Data

US 2019/0345420 A1 Nov. 14, 2019

Related U.S. Application Data

(63) Continuation of application No. PCT/EP2018/051664, filed on Jan. 24, 2018.

(30) Foreign Application Priority Data

Jan. 24, 2017 (DE) ..... 102017201097.5

(51) Int. Cl.

| | |
|---|---|
| ***C11D 17/00*** | (2006.01) |
| ***C11D 17/06*** | (2006.01) |
| ***C11D 3/20*** | (2006.01) |
| ***C11D 3/37*** | (2006.01) |
| ***C11D 3/38*** | (2006.01) |
| ***C11D 11/00*** | (2006.01) |

(52) U.S. Cl.

CPC ..... *C11D 17/0034* (2013.01); *C11D 3/2044* (2013.01); *C11D 3/2086* (2013.01); *C11D 3/3753* (2013.01); *C11D 3/38* (2013.01); *C11D 11/0023* (2013.01); *C11D 17/0008* (2013.01); *C11D 17/0047* (2013.01); *C11D 17/06* (2013.01)

(58) Field of Classification Search

None

See application file for complete search history.

(56) References Cited

U.S. PATENT DOCUMENTS 6,194,368 B1 * 2/2001 Waschenbach ..... C11D 3/0073 510/224
6,303,561 B1 * 10/2001 Painter ..... C11D 17/0078 510/224

(Continued)

FOREIGN PATENT DOCUMENTS

EP 2924106 A1 9/2015
KR 20140006661 A 1/2014

(Continued)

OTHER PUBLICATIONS

PCT International Search Report PCT/EP2018/051664 Completed: Mar. 26, 2018; dated Apr. 13, 2018 3 pages.

(Continued)

*Primary Examiner* — Lorna M Douyon
(74) *Attorney, Agent, or Firm* — Bojuan Deng

(57) ABSTRACT

A detergent or cleaning agent, in particular a cleaning agent for hard surfaces, having at least two phases which are different from one another.

17 Claims, 1 Drawing Sheet

(56) References Cited

U.S. PATENT DOCUMENTS

| | | | | |
|---|---|---|---|---|
| 6,486,117 | B1 * | 11/2002 | Painter | C11D 3/0052 134/25.2 |
| 2009/0018042 | A1 * | 1/2009 | Wiedemann | C11D 17/0078 510/224 |
| 2010/0113318 | A1 * | 5/2010 | Wiedemann | C11D 11/00 510/218 |
| 2012/0108487 | A1 * | 5/2012 | Graham | C11D 17/042 510/221 |
| 2016/0102279 | A1 | 4/2016 | Labeque et al. | |
| 2017/0218314 | A1 * | 8/2017 | Roy | C11D 3/43 |
| 2017/0253839 | A1 * | 9/2017 | Scheibel | C11D 3/43 |
| 2019/0085265 | A1 * | 3/2019 | Kurth | C11D 3/384 |

FOREIGN PATENT DOCUMENTS

| | | | |
|---|---|---|---|
| WO | 9924548 | A1 | 5/1999 |
| WO | 03099985 | A2 | 12/2003 |
| WO | 2004031338 | A1 | 4/2004 |
| WO | 2015118011 | A1 | 8/2015 |

OTHER PUBLICATIONS

Database WPI Week 201416; XP002779538-KR 2014 0006661 A (Dongwoo Fine-Chern Co., Ltd) Abstract; 2017, Clarivate Analytics; Thomson Scientific, London, GB; AN 2014-C20508.

International Cosmetic Ingredient Dictionary and Handbook. 7th ed., Edited by John A. Wenninger et al., The Cosmetic, Toiletry and Fragrance Association (CTFA), Washington D.C., USA, 1997.

* cited by examiner

DETERGENT OR CLEANING AGENT HAVING AT LEAST TWO PHASES

FIELD OF THE INVENTION

The present invention relates to a detergent or cleaning agent, in particular a cleaning agent for hard surfaces, comprising at least two different phases.

BACKGROUND OF THE INVENTION

Detergents or cleaning agents are usually present in solid form (as a powder, for example) or in liquid form (or also as a flowing gel). Solid detergents or cleaning agents have the advantage that, unlike liquid detergents or cleaning agents, they do not require any preservatives. Liquid product formats are increasingly gaining acceptance in the market, particularly due to their quick solubility and the resulting quick availability of the active ingredients they contain. This gives the consumer the option of using abbreviated rinse cycles while still obtaining good cleaning performance.

Furthermore, consumers have grown accustomed to the convenient metering of pre-portioned machine detergents or cleaning agents, such as dishwashing detergents, and use these products in the form of tablets (solid detergents or cleaning agents) or in the form of pouches that are filled with what is usually a liquid detergent or cleaning agent, with pouches filled with powder also being possible as single-use portions. Single-use portions in water-soluble pouches are popular with consumers not only because they no longer come into contact with the chemical composition, but rather, not least because of the attractive appearance of the pouches.

The appearance of the dosage form is becoming increasingly important. Besides good cleaning performance and adequate storage stability, a good appearance is one of the reasons on which the selection of a product is based. However, the visual performance of products that are stored in pouches frequently changes, which consumers often associate with reduced capacity and degraded cleaning performance.

Furthermore, there are active components of a detergent or cleaning agent which can be incorporated in liquid formulations only with difficulty. Accordingly, liquid active substances can be incorporated in powder formulations only to a limited extent.

BRIEF SUMMARY OF THE INVENTION

From the perspective of consumers, it is now desirable to combine the advantages of the two product formats and provide a dosage form that is improved compared with the prior art, particularly for detergents or cleaning agents that are usually liquids. Both single-use portioning and a visual appearance that is attractive to consumers should be achieved simultaneously. This should also be maintained during conventional storage. Surprisingly, it has been found that this object can be achieved by a formulation of a flexible phase that is combined with a solid phase.

In a first embodiment, the problem which forms the basis of the present application is therefore solved by a detergent or cleaning agent comprising at least one first phase (1) and at least one second phase (2) that is different therefrom, characterized in that the at least one first phase (1) is solid and is in particular a powder and the at least one second phase (2) comprises at least one polymer, at least one polyvalent alcohol and at least one organic acid, the pH of a 1% solution of the at least one second phase (2) in water at 20° C. being 6 or less.

The figures schematically show possible arrangements for the at least one first phase (1) and the at least one second phase (2). Within the meaning of the present invention, a phase is a spatial region in which physical parameters and the chemical composition are homogeneous. One phase differs from another phase on account of its different features, such as ingredients, physical properties, external appearance, etc. Preferably, different phases can be differentiated visually from one another. Therefore, the at least one first phase can be clearly distinguished visually by a consumer from the at least one second phase. The surface of the second phase should differ clearly from the first phase on account of a distinct luster, for example. The surface of the solid at least one first phase is usually not glossy but rather matte, dull, or muted, so that it is possible to make a clear distinction on account of the luster that makes the detergent or cleaning agent attractive to consumers.

If the detergent or cleaning agent according to the invention has more than one first phase, then they can also each be distinguished from one another with the naked eye because of their different coloration, for example. The same applies when two or more second phases are present. In this case as well, a visual differentiation of the phases, for example on the basis of a difference in color or transparency, is possible. Within the meaning of the present invention, phases are thus self-contained regions that can be differentiated visually from one another by a consumer with the naked eye. The individual phases can have different properties when used, such as the speed at which the phase dissolves in water and hence the speed and the sequence of the release of the ingredients contained in the particular phase.

According to the invention, the at least one second phase is dimensionally stable at room temperature. During preparation, the at least one polymer is brought into contact with the at least one polyvalent alcohol and the acid. This results in a flowable mixture being obtained that can be shaped as desired. After a certain period of time, a second phase is obtained that remains in the predefined shape, i.e., is dimensionally stable. This period of time, namely the setting time, is preferably 15 minutes or less, more preferably 10 minutes or less, particularly preferably 5 minutes. The at least one second phase yields on pressure but is not deformed as a result, but rather returns to its initial state once the pressure has been removed. The at least one second phase is preferably elastic, in particular linear-elastic. The at least one second phase is also preferably transparent, as a result of which a good visual impression is achieved. The at least one second phase is therefore gel-like. It is preferably free of solid substances that are not present in dissolved form. Therefore, the at least one second phase is not a solid phase in powder form.

The at least one second phase is sliceable. For example, it can be cut with a knife after it has set without being destroyed beyond the cut that is made. Moreover, the at least one second is in particular flexible. Due to its flexibility and elasticity, it can assume any shape. This also means that it has a level of breaking strength that enables good handling, in particular in terms of transport and storage, but also consumption.

DETAILED DESCRIPTION OF THE INVENTION

Figure 1:
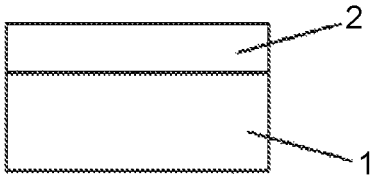
FIG. 1 schematically shows a possible arrangement of a first phase on or next to a second phase.

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate, but not to limit the invention and that, in particular, the invention is not limited to these examples. Unless indicated otherwise, all percentages are indicated in terms of wt. %. Numerical ranges given in the format "from x to y" also include the stated values. If several preferred numerical ranges are given in this format, it will readily be understood that all ranges that result from the combination of the various endpoints are also included.

"At least one", as used herein, means 1 or more, i.e., 1, 2, 3, 4, 5, 6, 7, 8, 9, or more. In relation to an ingredient, the expression refers to the type of ingredient and not to the absolute number of molecules. "At least one bleach catalyst" therefore means, for example, at least one type of bleach catalyst, i.e., that one type of bleach catalyst or a mixture of a plurality of different bleach catalysts may be meant. Together with weight data, the expression refers to all compounds of the indicated type that are contained in the composition/mixture, i.e., the composition does not contain any other compounds of this type beyond the indicated amount of the corresponding compounds.

When reference is made herein to molar masses, this information always refers to the number-average molar mass $M_n$, unless explicitly indicated otherwise. The number average of the molar mass can be determined, for example, by gel permeation chromatography (GPC) in accordance with DIN 55672-1:2007-08 using THF as the eluent. The number-average molar mass $M_w$ can also be determined by means of GPC as described for $M_n$.

Unless explicitly indicated otherwise, all percentages that are cited in connection with the compositions described herein relate to wt. %, in each case based on the relevant mixture.

In a preferred embodiment, the at least one first phase is present in compressed form. In this embodiment, the detergent or cleaning agent according to the invention thus comprises at least one first solid, compressed phase, and at least one second phase that comprises at least one polymer, at least one polyvalent alcohol and at least one organic acid.

Certain minimum requirements are placed on formulations of the at least one second phase. For instance, as already mentioned, the second phase must always set within as short a time as possible. Long setting times would result in a long production time and thus high costs. According to the invention, "setting time" refers to the period of time within which, during production, the at least one second phase goes from a flowable state to a state that is non-flowable and dimensionally stable at room temperature. Without constituting a restriction, this can be done by crosslinking the at least one polymer. Room temperature should be understood to mean a temperature of 20° C.

Furthermore, the second phase must be stable in storage, especially under conventional storage conditions. The second phase according to the invention is a component of a detergent or cleaning agent. Detergents or cleaning agents are usually stored for a certain period of time in a household. They are usually stored near the washing machine. The second phase should be stable under these storage conditions. Therefore, the second phase should in particular also be stable and not deform or otherwise change in consistency over a storage period of, for example, 4 to 12, in particular 10 to 12 weeks or longer at a temperature of up to 40° C., in particular at a temperature of 30° C., more particularly at a temperature of 25° C. or 20° C.

A change in volume or shrinkage during storage would be disadvantageous, since that would diminish consumers' acceptance of the product. The escape of liquid or the exudation of components from the second phase is also undesirable. Here, too, the visual impression is relevant, for one. The stability of the second phase can be influenced by the escape of liquid, such as solvent, such that the components are no longer stably contained, which can also impact the detergent or cleaning effect.

Moreover, it should be possible for the at least one first phase and the at least one second phase to be in direct contact with one another. In this case, there should be no negative interaction between the first phase and the second phase. What no negative interaction means here, for example, is that no ingredients or solvents go from one phase into the other or that the stability, in particular storage stability, preferably for 4 weeks and at a storage temperature of 30° C., and/or the aesthetics of the product are not impaired in any way, for example through a change in color, the formation of wet-looking edges, a blurred boundary between the two phases, or the like.

Surprisingly, it has been found that a second phase comprising an organic acid provides for particularly good storage stability and a particularly good combination with an at least first solid phase. However, suitable organic acids have a $pK_a$ value of from 0 to 8, in particular from 1 to 4.5, particularly preferably from 1.5 to 4. If an organic acid has several $pK_a$ values, what is meant according to the invention is the $pK_{a1}$ value.

Particularly suitable are citric acid, glutaric acid, tartaric acid, glycolic acid, oxalic acid and/or sulfamic acid. These acids can be used alone or in combination with one another. An acid is preferably used alone. If citric acid is used as the organic acid, this should be understood to mean the anhydrate or the monohydrate. Oxalic acid can be used in particular in the form of a dihydrate.

When glutaric acid is used, the curing time is very quick, and therefore glutaric acid is preferred from this point of view. By comparison with other acids, sulfamic acid can result in slower curing. Since short curing times are preferred, sulfamic acid is less preferred.

Particularly preferably, the organic acid is selected from citric acid (anhydrate or monohydrate), glutaric acid, tartaric acid, glycolic acid and/or oxalic acid, more particularly preferably citric acid (anhydrate or monohydrate), glutaric acid and/or tartaric acid. L(+) tartaric acid is preferably used as tartaric acid. The use of L(+) tartaric acid and citric acid (both the anhydrate and monohydrate) yields comparable properties of the at least one second phase. By means of tartaric acid, visual effects, such as in particular inhomogeneous coloring, can be achieved that cannot be produced or are difficult to produce using citric acid.

Citric acid is particularly preferably used in the form of the anhydrate or the monohydrate, since these can be obtained inexpensively and lead to good products in terms of storage conditions, curing time and handling behavior.

It has surprisingly been found that the pH of the at least one second phase has an influence on the stability of the detergent or cleaning agent as a whole. In particular, the interaction between the at least one first solid phase and the at least one second phase is influenced hereby. The first phase is present as a solid, and in particular compressed phase. Said first phase is preferably a powder detergent or cleaning agent in the form of a tablet. The at least one first phase is also preferably in direct contact with the at least one second phase. Here, the problem is often that this leads to interactions between the first and second phase, and therefore the components contained in the at least one first phase are dissolved by the second phase. As a result, the adhesion between the two phases can be negatively affected, and this leads to the two being separated. Furthermore, changes in visual appearance or odor may occur as a result that have a negative impact on the consumer's acceptance of a corresponding product. Furthermore, incompatible active ingredients, which were originally deliberately separated by the two phases, may come into contact with one another, which may have a negative impact on effectiveness.

Surprisingly, it has now been found that these disadvantages can be avoided if the pH of a 1% solution of at least one second phase (2) in water at 20° C. is 6 or less. The pH is preferably in the range of from 1 to 5, in particular in the range of from 2 to 4.

The pH was determined while the at least one second phase (2) was being prepared. A first sampling process took place immediately after all the components contained in the second phase had been mixed, and at the end of the preparation process. The pH did not change significantly.

The proportion of organic acid contained in the at least one second phase (2) is dependent on the type of acid; however, it is preferably in the range of from 5 wt. % to 20 wt. %, in particular from 7 wt. % to 14 wt. %, based on the total weight of the second phase (2). Corresponding amounts of organic acid are sufficient for allowing for the desired pH. At the same time, a higher amount of organic acid does not result in further improvements. On the contrary, the curing time is usually made longer. Additionally, storage stability with significantly higher concentrations of organic acid is outside of the preferred range.

Surprisingly, it has been found that particularly good storage stability is achieved if the at least one second phase (2) is substantially water-free. This means that the at least one second phase (2) is preferably substantially free of water. Here, "substantially free" means that low amounts of water may be contained in the second phase. For example, this water can be introduced into the phase as crystallization water or as a result of reactions between components of the phase. No water is added while the second phase is being prepared, however. The proportion of water in the second phase is, in particular, 15 wt. % or less, or 10 wt. % or less, more particularly 7 wt. % or less, even more particularly 6 wt. % or 5 wt. % or less, preferably 2 wt. % or less, in particular 1 wt. % or less, more particularly 0.5 wt. % or less, even more particularly 0.1 wt. % or 0.05 wt. % or less. The amounts in wt. % refer to the total weight of the second phase (2).

The at least one second phase (2) comprises at least one polymer. The at least one polymer is particularly suitable for forming a network. According to the invention, the at least one second phase can comprise one polymer, or two or more different polymers. In particular, it comprises one, two or more, in particular one or two, preferably one, polymer suitable for forming a network. Furthermore, the at least one second phase may comprise one or more polymers which do not form a network, but which result in the at least one second phase being thickened and thus more dimensionally stable, which polymers being referred to as thickening polymers. In a preferred embodiment, the at least one second phase thus comprises at least one, preferably one, polymer for forming networks, and one or more thickening polymers.

Preferably, the at least one second phase comprises PVA (polyvinyl alcohol) and/or gelatin as polymers suitable for forming networks. The at least one second phase also preferably comprises a thickening polymer, and in particular polycarboxylates as a thickening polymer.

Polyvinyl alcohols are thermoplastic materials that are produced as white to yellowish powders, usually by hydrolysis of polyvinyl acetate. Polyvinyl alcohol (PVA) is resistant to almost all water-free organic solvents. Polyvinyl alcohols having a molar mass of from 30,000 to 60,000 g/mol are preferred.

Gelatin is a mixture of substances consisting of taste-neutral animal protein. The main component is denatured or hydrolyzed collagen, which is produced from the connective tissue of various animal species. Gelatin lacks the essential amino acid tryptophan, and so it is not considered to be a complete protein. Gelatin swells in water and dissolves when heated starting at approximately 50° C. When cooled, it forms a gel that liquefies again when reheated.

Surprisingly, it has been found that PVA and/or gelatin is particularly suitable for preparing second phases that meet the requirements outlined above. At least one second phase that comprises gelatin and/or PVA, at least one polyvalent alcohol and at least one organic acid is therefore particularly preferred. Particularly preferably, the at least one second phase comprises gelatin and at least one polyvalent alcohol. The at least one second phase also preferably comprises PVA, at least one polyvalent alcohol, and at least one organic acid.

According to the invention, the at least one second phase comprises the polymer suitable for forming networks in a proportion of from approximately 5 wt. % to 40 wt. %, in particular from 10 wt. % to 35 wt. %, preferably from 15 wt. % to 30 wt. %, in particular from 18 to 28 wt. %. Significantly lower proportions of polymers, in particular gelatin and/or PVA, do not result in the formation of a gel-like second phase that is stable even at storage temperatures of 40° C. Instead, permanent flowing can be observed at storage temperatures of 40° C. and above. Furthermore, the phases remain soft for longer, which results in a prolonged hardening time and thus a prolonged production process. Proportions of more than 40 wt. % and in particular of more than 30 wt. % result in decreased processability; in particular, phases of this kind cannot be stirred very easily and are barely flowable. Each value is based on the total weight of the second phase.

Particularly preferably, the at least one second phase (2) comprises gelatin. Surprisingly, it has been found that, with the aid of gelatin, dimensionally stable second phases can be prepared within a short curing time. Furthermore, the shape and size of phases prepared in this way remain stable over a long period of time. No size-shrinkage can be observed. It has been found that the amount of gelatin that has to be used varies according to the bloom value. The second phase therefore preferably comprises gelatin having a bloom value in the range of from 60 to 225. The bloom value describes the gel strength or gelling quality of gelatin. The characteristic number is the mass in grams that is required in order for a stamp measuring 0.5 inches in diameter to deform the surface of a 6.67% gelatin/water mixture four millimeters deep without breaking it. The test is conducted in a standardized manner at exactly 10° C. with previous aging of the gelatin for 17 hours.

If the at least one second phase (2) comprises gelatin having a bloom value of 150 or more, in particular from 180 to 225, preferably from 200 to 225, the gelatin proportion based on the total weight of the second phase is preferably in the range of from 10 wt. % to 30 wt. %, in particular from 15 wt. % to 25 wt. %. If the bloom value is less than 150, in particular from 60 to 120, preferably from 60 to 100, the gelatin proportion based on the total weight of the second phase is preferably in the range of from 15 wt. % to 30 wt. %, in particular from 20 wt. % to 25 wt. %. Gelatin having a bloom value of 180 or more, in particular of 200 or more, more particularly 225, is preferred. The use of gelatin having a corresponding bloom value makes it possible to have good control over the viscosity of the second phase during preparation. Furthermore, the amount of gelatin required here is less than when gelatin having a lower bloom value is used, and this can result in a reduction in cost.

If the at least one second phase (2) comprises not only gelatin but also PVA, the tenacity of the second phase (2) during preparation is increased.

Surprisingly, it has been found that gelatin, together with anionic polymers or copolymers, in particular with sulfopolymers, leads to the formation of second phases having hard-wearing surfaces. The end consumer can touch surfaces of this kind without material adhering to their hands. Furthermore, no material comes off in packaging. The second phase therefore preferably comprises gelatin and an anionic copolymer/polymer. The proportion of the anionic polymer is preferably from 1 wt. % to 35 wt. %, in particular from 3 wt. % to 30 wt. %, more particularly from 5 wt. % to 25 wt. %, preferably from 5 wt. % to 20 wt. %, based on the total weight of the second phase. Sulfopolymers also provide the surface with an outstanding luster. What is more, fingerprints are not left behind. The proportion of sulfopolymers, in particular of sulfopolymers having AMPS as the sulfonic acid group-containing monomer, such as Acusol 590, Acusol 588, or Sokalan CP50, is therefore preferably from 1 wt. % to 25 wt. %, in particular from 3 wt. % to 15 wt. %, more particularly from 4 wt. % to 12 wt. %, preferably from 5 wt. % to 10 wt. %, based on the weight of the second phase. In a particularly preferred embodiment, the at least one second phase therefore comprises gelatin, a sulfopolymer and at least one polyvalent alcohol.

According to the invention, the at least one second phase (2) can further comprise at least one thickening polymer. This is preferably a polycarboxylate. A copolymeric polyacrylate, preferably a sulfopolymer, more preferably a copolymeric polysulfonate, even more preferably a hydrophobically modified copolymeric polysulfonate, is preferably used as the polycarboxylate. The copolymers can have two, three, four or more different monomer units. Preferred copolymeric polysulfonates contain, in addition to sulfonic acid group-containing monomer(s), at least one monomer from the group of unsaturated carboxylic acids.

As unsaturated carboxylic acid(s), unsaturated carboxylic acids of the formula $R^1(R^2)C{=}C(R^3)COOH$ are particularly preferably used, in which $R^1$ to $R^3$ represent, independently of one another, —H, —$CH_3$, a straight-chain or branched saturated alkyl functional group having 2 to 12 carbon atoms, a straight-chain or branched, mono or polyunsaturated alkenyl functional group having 2 to 12 carbon atoms, —NH2, —OH, or —COOH-substituted alkyl or alkenyl functional groups as defined above, or —COOH or —$COOR^4$, where $R^4$ is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, a-cyanoacrylic acid, crotonic acid, α-phenylacrylic acid, maleic acid, maleic anhydride, fumaric acid, itaconic acid, citraconic acid, methylenemalonic acid, sorbic acid, cinnamic acid, or mixtures thereof. Unsaturated dicarboxylic acids can obviously also be used.

Among the sulfonic acid group-containing monomers, those of the formula $R^5(R^6)C{=}C(R^7)$—X—$SO_3H$ are preferred, in which $R^5$ to $R^7$ represent, independently of one another, —H, —$CH_3$, a straight-chain or branched saturated alkyl functional group having 2 to 12 carbon atoms, a straight-chain or branched, mono or polyunsaturated alkenyl functional group having 2 to 12 carbon atoms, —$NH_2$, —OH, or —-COOH-substituted alkyl or alkenyl functional groups, or —COOH or —$COOR^4$, where $R^4$ is a saturated or unsaturated, straight-chain or branched hydrocarbon functional group having 1 to 12 carbon atoms, and X represents an optionally present spacer group that is selected from —$(CH_2)_n$- where n=0 to 4, —COO—$(CH_2)_k$- where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Among said monomers, the preferred are those of the formulas $H_2C{=}CH$—X—$SO_3H$, $H_2C{=}C(CH_3)$—X—$SO_3H$ or $HO_3S$—X—$(R^6)C{=}C(R^7)$—X—$SO_3H$, in which $R^6$ and $R^7$ are selected, independently of one another, from —H, —$CH_3$, —$CH_2CH_3$, —$CH_2CH_2CH_3$, and —$CH(CH_3)_2$, and X represents an optionally present spacer group that is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfnic acid, 2-methyl-2-propene-1-sulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the mentioned acids or the water-soluble salts thereof. The sulfonic acid groups may be present in the polymers in a completely or partially neutralized form, i.e. the acidic hydrogen atom of the sulfonic acid group can be exchanged in some or all of the sulfonic acid groups for metal ions, preferably alkali metal ions, and in particular for sodium ions. The use of partially or fully neutralized sulfonic acid group-containing copolymers is preferred according to the invention.

In copolymers that only contain carboxylic acid group-containing monomers and sulfonic acid group-containing monomers, the monomer distribution of the copolymers that are preferably used according to the invention is from 5 to 95 wt. %; particularly preferably, the proportion of sulfonic acid group-containing monomers is from 50 to 90 wt. %, and the proportion of carboxylic acid group-containing monomers is from 10 to 50 wt. %, with the monomers being preferably selected from among those mentioned above. The molar mass of the sulfo-copolymers that are preferably used according to the invention can be varied in order to adapt the properties of the polymers to the desired use. Preferred cleaning agents are characterized in that the copolymers have molar masses of from 2,000 to 200,000 $g \cdot mol^{-1}$, preferably from 4,000 to 25,000 $g \cdot mol^{-1}$, and in particular from 5,000 to 15,000 $g \cdot mol^{-1}$.

In another preferred embodiment, the copolymers comprise not only carboxyl group-containing monomers and sulfonic acid group-containing monomers but also at least one nonionic, preferably hydrophobic monomer. In particular, the rinsing performance of dishwashing detergents according to the invention could be improved by the use of these hydrophobically modified polymers.

Particularly preferably, the at least one second phase further comprises an anionic copolymer, with a copolymer comprising i) carboxylic acid group-containing monomers ii) sulfonic acid group-containing monomers iii) nonionic monomers, in particular hydrophobic monomers, being used as the anionic copolymer.

Monomers of the general formula $R^1(R^{hu\ 2})C{=}C(R^3)$—X—$R^4$ are preferably used as nonionic monomers $$R^1(R^2)C{=}C(R^3)—X—R^4$$

in which formula $R^1$ to $R^3$ represent, independently of one another, —H, —$CH_3$ or —$C_2H_5$, X represents an optionally present spacer group that is selected from —$CH_2$—, —C(O)O— and —C(O)—NH—, and $R^4$ represents a straight-chain or branched saturated alkyl functional group having 2 to 22 carbon atoms or an unsaturated, preferably aromatic, functional group having 6 to 22 carbon atoms.

Particularly preferred nonionic monomers are butene, isobutene, pentene, 3-methylbutene, 2-methylbutene, cyclopentene, hexene, hexene-1, 2-methylpentene-1, 3-methylpentene-1, cyclohexene, methylcyclopentene, cycloheptene, methylcyclohexene, 2,4,4-trimethylpentene-1, 2,4,4-trimethylpentene-2,2,3-dimethylhexene-1, 2,4-dimethylhexene-1, 2,5-dimethlyhexene-1, 3,5-dimethyl-hexene-1, 4,4-dimethylhexane-1, ethylcyclohexene, 1-octene, α-olefins having 10 or more carbon atoms such as 1-decene, 1-dodecene, 1-hexadecene, 1-octadecene and $C_{22}$-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinyl naphthalene, 2-vinyl naphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid-2-ethylhexyl ester, methacrylic acid-2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide or mixtures thereof, in particular acrylic acid, ethyl acrylate, 2-acrylamido-2-methylpropane sulfonic acid (AMPS) and mixtures thereof According to the invention, the at least one second phase can also comprise additional polymers, such as PEG, in particular polyethylene glycols having an average molar mass of between approximately 200 and 8,000, between approximately 800 and 4,000 g/mol, particularly preferably having an average molar mass of between 1,000 and 2,000 g/mol, for example approximately 1,500 g/mol (INCI: PEG1500), which increase the stability of the second phase.

The at least one second phase (2) further comprises at least one polyvalent alcohol. The at least one polyvalent alcohol makes it possible to prepare a dimensionally stable, non-flowable second phase within a short setting time that is within 15 minutes or less, in particular 10 minutes or less. Polyvalent alcohols within the meaning of the present invention are hydrocarbons in which two, three, or more hydrogen atoms are replaced by OH groups. The OH groups are each bonded to different carbon atoms. Therefore, no carbon atom has two OH groups. This is in contrast to (simple) alcohols, in which only one hydrogen atom is replaced by an OH group in hydrocarbons. Polyvalent alcohols having two OH groups are referred to as alkanediols, and polyvalent alcohols having three OH groups are referred to as alkanetriols. A polyvalent alcohol thus corresponds to the general formula $[KW](OH)_x$, where KW represents a hydrocarbon that is linear or branched, saturated or unsaturated, substituted or unsubstituted. A substitution can occur with —SH or —NH groups, for example. Preferably, KW is a linear or branched, saturated or unsaturated, unsubstituted hydrocarbon. In this case, KW comprises at least two carbon atoms. The polyvalent alcohol comprises 2, 3, or more OH groups (x=2, 3, 4, . . . ), with only one OH group being bonded to each C atom of the KW. Particularly preferably, KW comprises 2 to 10, i.e., 2, 3, 4, 5, 6, 7, 8, 9, or 10 carbon atoms. Polyvalent alcohols in which x=2, 3, or 4 can be used in particular (for example, pentaerythritol where x=4). Preferably, x=2 (alkanediol) and/or x=3 (alkanetriol). In particular, the at least one second phase (2) comprises at least one alkanediol. The alkanediol is particularly preferably a $C_3$ to $C_{10}$ alkanediol, more particularly preferably a $C_3$ to $C_5$ alkanediol.

Particularly preferably, the at least one second phase (2) comprises at least one alkanetriol and/or at least one alkanediol, in particular at least one $C_3$ to $C_{10}$ alkanetriol and/or at least one $C_3$ to $C_{10}$ alkanediol, preferably at least one $C_3$ to $C_8$ alkanetriol and/or at least one $C_3$ to $C_8$ alkanediol, in particular at least one $C_3$ to $C_6$ alkanetriol and/or at least one $C_3$ to $C_5$ alkanediol, as a polyvalent alcohol. The at least one second phase preferably comprises an alkanetriol and an alkanediol as at least one polyvalent alcohol. In a preferred embodiment, the at least second phase thus comprises at least one polymer, in particular gelatin and/or PVA, as well as at least one alkanediol and at least one alkanetriol, in particular one alkanetriol and one alkanediol. A second phase that comprises at least one polymer, in particular gelatin and/or PVA, at least one organic acid, as well as a $C_3$ to $C_8$ alkanediol and a $C_3$ to $C_8$ alkanetriol is also preferred. A second phase that comprises at least one polymer, in particular gelatin and/or PVA, at least one organic acid, as well as a $C_3$ to $C_5$ alkanediol and a $C_3$ to $C_6$ alkanetriol is also preferred. A second phase that comprises at least one polymer, in particular gelatin and/or PVA, at least one organic acid, as well as a $C_3$ to $C_{10}$ alkanediol and a $C_3$ to $C_5$ alkanetriol is particularly preferred.

The terms "diol" and "alkanediol" are used synonymously herein. The same applies to "triol" and "alkanetriol."

According to the invention, the polyvalent alcohols do not comprise any derivatives, such as ethers, esters, etc.

The amount of polyvalent alcohol or polyvalent alcohols used in second phases according to the invention is preferably at least 45 wt. %, in particular 55 wt. % or more. Preferred amount ranges are from 5 wt. % to 75 wt. %, in particular from 10 wt. % to 70 wt. %, based on the total weight of the second phase.

Preferably, the $C_3$ to $C_6$ alkanetriol is glycerin and/or 2-ethyl-2-(hydroxymethyl)-1,3-propanediol (also called 1,1,1-trimethylolpropane) and/or 2-amino-2-(hydroxymethyl)-1,3-propanediol (TRIS, tris hydroxymethyl aminoethane).

These are particularly suitable for incorporating active ingredients homogeneously into the at least one second phase.

Particularly preferably, the $C_3$ to $C_6$ alkanetriol is glycerin and/or 2-ethyl-2-(hydroxymethyl)-1,3-propanediol (also called 1,1,1-trimethylolpropane). The $C_3$ to $C_5$ alkanediol is preferably 1,3-propanediol and/or 1,2-propanediol. Surprisingly, it has been found that the chain length of the diol as well as, in particular, the position of the OH groups has an influence on the transparency of the second phase. The OH groups of the diol are therefore preferably not arranged on immediately adjacent C atoms. In particular, three or four carbon atoms, in particular three carbon atoms, are located between the two OH groups of the diol. Particularly preferably, the diol is 1,3-propanediol. Surprisingly, it has been found that particularly good results are achieved using mixtures that comprise glycerin and 1,3-propanediol and/or 1,2-propanediol. Particularly preferably, the second phase (2) comprises gelatin, glycerin, and 1,3-propanediol or gelatin, 1,1,1-trimethylolpropane and 1,3-propanediol, in addition to the at least one organic acid. In this case, a non-flowable consistency that is dimensionally stable at room temperature can be achieved within a setting time of 10 minutes or less, which consistency remains dimensionally stable even after an extended storage period. In addition, such a phase is transparent and has a glossy surface. A particularly preferred second phase therefore comprises gelatin or PVA as a polymer, 1,3-propanediol and glycerin or 1,1,1-trimethylolpropane as polyvalent alcohols, and citric acid as an organic acid.

If the second phase (2) comprises an alkanetriol, in particular glycerin or 1,1,1-trimethylolpropane, the proportion of alkanetriol, in particular glycerin or 1,1,1-trimethylolpropane, is preferably from 5 wt. % to 70 wt. %, in particular from 10 wt. % to 65 wt. %, more particularly from 20 wt. % to 40 wt. %, based on the total weight of the second phase.

If the second phase optionally comprises several alkanetriol(s), the total proportion of alkanetriol(s) is preferably from 5 wt. % to 70 wt. %, in particular from 10 wt. % to 65 wt. %, more particularly from 20 wt. % to 40 wt. %, based on the total weight of the second phase.

If glycerin is contained as an alkanetriol in the second phase, the proportion of glycerin is preferably from 5 wt. % to 70 wt. %, in particular from 10 wt. % to 65 wt. %, more particularly from 20 wt. % to 40 wt. %, based on the total weight of the second phase.

If 1,1,1-trimethylolpropane is contained in the second phase, the proportion of 1,1,1-trimethylolpropane is preferably from 1 wt. % to 50 wt. %, in particular from 5 wt. % to 30 wt. %, more particularly from 10 wt. % to 20 wt. %, based on the total weight of the second phase.

If 2-amino-2-hydroxymethyl-1,3-propanediol is contained in the second phase, the proportion of 2-amino-2-hydroxymethyl-1,3-propanediol is preferably from 1 wt. % to 70 wt. %, in particular from 5 wt. % to 50 wt. %, more particularly from 10 or 20 wt. % to 40 wt. %, based on the total weight of the second phase.

If several alkanediols are optionally contained in the second phase, the proportion of alkanediols is preferably from 5 wt. % to 70 wt. %, in particular from 10 wt. % to 65 wt. %, more particularly from 20 wt. % to 40 wt. %, based on the total weight of the second phase.

If the second phase comprises an alkanediol, in particular 1,3-propanediol, the proportion of alkanediol, in particular 1,3-propanediol is preferably from 5 wt. % to 70 wt. %, in particular from 15 wt. % to 65 wt. %, more particularly from 30 wt. % to 60 wt. %, based on the total weight of the second phase. If 1,3-propanediol is contained in the second phase, the proportion of 1,3-propanediol is in particular from 10 wt. % to 65 wt. %, more particularly from 20 wt. % to 45 wt. %, based on the total weight of the second phase.

It has been found that, in these ranges, rapid setting of a second phase at 20° C. is possible; the obtained phases are storage-stable and transparent.

If the at least one second phase according to the invention comprises a $C_3$ to $C_6$ alkanetriol and a $C_3$ to $C_5$ alkanediol, the weight ratio is preferably from 3:1 to 2:1. In particular, the weight ratio is 2:1 if glycerin and 1,3-propanediol are contained as polyvalent alcohols. Surprisingly, it has been found that, with these weight ratios, storage-stable, glossy, transparent second phases can be obtained within short setting times of 10 minutes or less at 20° C.

Surprisingly, it has been found that storage stability can be improved, in particular at higher temperatures, if the at least one second phase (2) comprises 2-methyl-2-hydroxy methyl-1,3-propanediol and/or 2-ethyl-2-hydroxymethyl-1,3-propanediol, in particular 2-methyl-2-hydroxymethyl-1,3-propanediol. In a preferred embodiment, the at least one phase therefore further comprises 2-methyl-2-hydroxymethyl-1,3-propanediol and/or 2-ethyl-2-hydroxymethyl-1,3-propanediol, in particular 2-methyl-2-hydroxymethyl 1,3-propanediol, in particular in a proportion of 25 wt. % or less, preferably of 20 wt. % or less, in each case based on the total weight of the at least one second phase (2).

The detergent or cleaning agent according to the invention preferably comprises at least one surfactant. This surfactant is selected from the group of anionic, nonionic, and cationic surfactants. The detergent or cleaning agent according to the invention can also contain mixtures of several surfactants that are selected from the same group.

According to the invention, the at least one first phase (1) and the at least one second phase (2) each contain at least one surfactant. It is also possible, however, for only the at least one first phase (1) or only the at least one second phase (2) to comprise at least one surfactant. If both phases comprise a surfactant, then they are preferably mutually different surfactants. It is also possible, however, for the first and second phases to have the same surfactant or surfactants. The at least one first and/or second phases according to the invention preferably contain at least one nonionic surfactant. All nonionic surfactants that are known to a person skilled in the art can be used as nonionic surfactants. Low-foaming nonionic surfactants are preferably used, in particular alkoxylated, more particularly ethoxylated, low-foaming nonionic surfactants. These will be specified in greater detail below.

Suitable nonionic surfactants include, for example, alkyl glycosides of the general formula $RO(G)_x$, in which R corresponds to a primary straight-chain or methyl-branched aliphatic functional group, in particular an aliphatic functional group that is methyl-branched in position 2, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably 1.2 to 1.4.

Another class of nonionic surfactants that are preferably used, which are used either as the sole nonionic surfactant or in combination with other nonionic surfactants, is alkoxylated, preferably ethoxylated or ethoxylated and propoxylated, fatty acid alkyl esters, preferably having 1 to 4 carbon atoms in the alkyl chain.

Nonionic surfactants of the amine oxide type, for example N-cocoalkyl-N,N-dimethylamine oxide and N-tallow alkyl-N,N-dihydroxyethylamine oxide, and of the fatty acid alkanolamide type can also be suitable. The amount of these nonionic surfactants is preferably no more than that of the ethoxylated fatty alcohols, in particular no more than half thereof.

Other suitable surfactants are the polyhydroxy fatty acid amides that are known as PHFAs.

Particularly preferably, the detergent or cleaning agents, in particular cleaning agents for automatic dishwashing, contain nonionic surfactants from the group of alkoxylated alcohols. Nonionic surfactants that are preferably used are alkoxylated, advantageously ethoxylated, in particular primary alcohols having preferably 8 to 18 C atoms and, on average, 1 to 12 mols of ethylene oxide (EO) per mol of alcohol, in which the alcohol functional group can be linear or preferably methyl-branched in position 2, or can contain linear and methyl-branched functional groups in admixture, as are usually present in oxo alcohol functional groups. However, alcohol ethoxylates having linear functional groups of alcohols of native origin having 12 to 18 C atoms, for example of coconut alcohol, palm alcohol, tallow fatty alcohol or oleyl alcohol, and an average of 2 to 8 EO per mol of alcohol are particularly preferred. Preferred ethoxylated alcohols include, for example, $C_{12-14}$ alcohols having 3 EO or 4 EO, $C_{8-11}$ alcohols having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO.

Preferred alcohol ethoxylates have a narrowed homolog distribution (narrow range ethoxylates, NRE). In addition to these nonionic surfactants, fatty alcohols having more than 12 EO can also be used. Examples of these are tallow fatty alcohols having 14 EO, 25 EO, 30 EO, or 40 EO.

Ethoxylated nonionic surfactants are particularly preferably used which were obtained from $C_{6-20}$ monohydroxy alkanols or $C_{6-20}$ alkyl phenols or C16-20 fatty alcohols and more than 12 mols, preferably more than 15 mols, and in particular more than 20 mols of ethylene oxide per mol of alcohol. A particularly preferred nonionic surfactant is obtained from a straight-chain fatty alcohol having 16 to 20 carbon atoms (C16-20 alcohol), preferably from a C18 alcohol and at least 12 mols, preferably at least 15 mols, and in particular at least 20 mols of ethylene oxide. Among these, what are referred to as "narrow range ethoxylates" are particularly preferred.

Surfactants that can preferably be used originate from the groups of alkoxylated nonionic surfactants, in particular ethoxylated primary alcohols, and mixtures of these surfactants with structurally complicated surfactants such as polyoxypropylene/polyoxyethylene/polyoxypropylene ((PO/EO/PO) surfactants). (PO/EO/PO) nonionic surfactants of this kind are also distinguished by good foam control.

In the context of the present invention, low-foaming nonionic surfactants which have alternating ethylene oxide and alkylene oxide units have been found to be particularly preferred nonionic surfactants. Among these, in turn, surfactants having EO-AO-EO-AO blocks are preferred, with one to ten EO groups or AO groups being bonded to one another before a block of the other group follows. Here, nonionic surfactants of the below general formula are preferred $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

in which $R^1$ represents a straight-chain or branched, saturated or mono or polyunsaturated $C_{6-24}$ alkyl or alkenyl functional group; each $R_2$ and $R_3$ group is selected, independently of one another, from $—CH_3$, $—CH_2CH_3$, $—CH_2CH_2—CH_3$, $—CH(CH_3)_2$; and the indices w, x, y and z represent, independently of one another, integers from 1 to 6.

Preferred nonionic surfactants of the above formula can be prepared, using known methods, from the corresponding alcohols $R^1$—OH and ethylene or alkylene oxide. The $R^1$ functional group in the above formula can vary depending on the origin of the alcohol. If native sources are used, the $R^1$ functional group has an even number of carbon atoms and is generally unbranched, with the linear functional groups of alcohols of native origin having 12 to 18 C atoms, such as coconut, palm, tallow fat, or oleyl alcohol, being preferred. Some examples of alcohols that are available from synthetic sources are the Guerbet alcohols or functional groups that are methyl-branched in position 2, or functional groups that are linear and methyl-branched in admixture, such as those usually present in oxo alcohol functional groups. Irrespective of the approach taken to prepare the alcohol used in the nonionic surfactants contained in the agents, preferred are nonionic surfactants in which $R^1$ represents an alkyl functional group having 6 to 24, preferably 8 to 20, particularly preferably 9 to 15, and in particular 9 to 11, carbon atoms in the above formula.

In addition to propylene oxide, butylene oxide in particular is worthy of consideration as an alkylene oxide unit that is contained alternately with the ethylene oxide unit in the preferred nonionic surfactants. However, other alkylene oxides in which $R^2$ and $R^3$ are selected, independently of one another, from $—CH_2CH_2—CH_3$ and $—CH(CH_3)_2$ are also suitable. Preferably, nonionic surfactants of the above formula are used in which $R^2$ and $R^3$ represent a $—CH_3$ functional group, w and x represent, independently of one another, values of 3 or 4, and y and z represent, independently of one another, values of 1 or 2.

Other nonionic surfactants of the first phase that are preferably used are nonionic surfactants of the general formula $$R^1O(AlkO)_xM(OAlk)_yOR^2,$$

where $R^1$ and $R^2$ represent, independently of one another, a branched or unbranched, saturated or unsaturated, optionally hydroxylated alkyl functional group having 4 to 22 carbon atoms; Alk represents a branched or unbranched alkyl functional group having 2 to 4 carbon atoms; x and y represent, independently of one another, values of between 1 and 70; and M represents an alkyl functional group from the group $CH_2$, $CHR^3$, $CR^3R^4$, $CH_2CHR^3$ and $CHR^3CHR^4$, where $R^3$ and $R^4$ represent, independently of one another, a branched or unbranched, saturated or unsaturated alkyl functional group having 1 to 18 carbon atoms.

Nonionic surfactants of the below general formula are preferred $$R^1—CH(OH)CH_2—O(CH_2CH_2O)_xCH_2CHR(OCH_2CH_2)_y—CH_2CH(OH)—R^2,$$

where R, $R^1$ and $R^2$ represent, independently of one another, an alkyl functional group or alkenyl functional group having 6 to 22 carbon atoms; x and y represent, independently of one another, values of between 1 and 40.

Compounds of the below general formula are particularly preferred $$R^1—CH(OH)CH_2—O(CH_2CH_2O)_xCH_2CHR(OCH_2CH_2)_yO—CH_2CH(OH)—R^2,$$

in which R represents a linear, saturated alkyl functional group having 8 to 16 carbon atoms, preferably 10 to 14 carbon atoms, and n and m assume, independently of one another, values of from 20 to 30. Such compounds can be obtained, for example, by reacting alkyl diols HO—CHR—$CH_2$—OH with ethylene oxide, a reaction with an alkyl epoxide being subsequently carried out in order to occlude the free OH functions, thus forming a dihydroxy ether.

Preferred nonionic surfactants are those of the general formula $R^1—CH(OH)CH_2O—(AO)_w—(AO)_x—(A''O)_y—(A'''O)_z—R^2$, in which

- $R^1$ represents a straight-chain or branched, saturated or mono or polyunsaturated $C_{6-24}$ alkyl or alkenyl functional group;
- $R^2$ represents hydrogen or a linear or branched hydrocarbon functional group having 2 to 26 carbon atoms;
- A, A', A'' and A''' represent, independently of one another, a functional group from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$;
- w, x, y and z represent values of between 0.5 and 120, where x, y and/or z can also be 0.

By adding the above-mentioned nonionic surfactants of the general formula $R^1—CH(OH)CH_2O—(AO)_w—(A'O)_x—(A''O)_y—(A'''O)_z—R^2$, hereinafter also referred to as "hydroxy mixed ethers," the cleaning performance of preparations according to the invention can be surprisingly improved to a significant extent, specifically both in comparison with surfactant-free systems and in comparison with systems that contain alternative nonionic surfactants, such as those from the group of polyalkoxylated fatty alcohols.

By using these nonionic surfactants having one or more free hydroxyl groups on one or both terminal alkyl functional groups, the stability of the enzymes contained in the cleaning agent preparations according to the invention can be improved significantly.

In particular, end-capped poly(alkoxylated) nonionic surfactants are preferred which, according to the following formula,

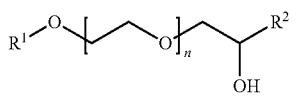

in addition to a functional group $R^1$, which represents linear or branched, saturated or unsaturated, aliphatic or aromatic hydrocarbon functional groups having 2 to 30 carbon atoms, preferably having 4 to 22 carbon atoms, also comprise a linear or branched, saturated or unsaturated, aliphatic or aromatic hydrocarbon functional group $R^2$ having 1 to 30 carbon atoms, where n represents values of between 1 and 90, preferably values of between 10 and 80, and in particular values of between 20 and 60. Surfactants of the above formula in which $R^1$ represents $C_7$ to $C_{13}$, n represents a whole natural number from 16 to 28, and $R^2$ represents $C_8$ to $C_{12}$ are particularly preferred.

Particularly preferred are surfactants of the formula $R^1O[CH_2CH(CH_3)O]_x[CH_2CH_2O]_yCH_2CH(OH)R^2$ in which $R^1$ represents a linear or branched aliphatic hydrocarbon functional group having 4 to 18 carbon atoms or mixtures thereof, $R^2$ represents a linear or branched hydrocarbon functional group having 2 to 26 carbon atoms or mixtures thereof, x represents values of between 0.5 and 1.5, and y represents a value of at least 15. The group of these nonionic surfactants includes, for example, $C_{2-26}$ fatty alcohol-$(PO)_1$-$(EO)_{15-40}$-2-hydroxyalkyl ethers, in particular also $C_{8-10}$ fatty alcohol-$(PO)_1$-$(EO)_{22}$-2-hydroxydecyl ethers.

Particularly preferred are also end-capped poly(oxyalkylated) nonionic surfactants of the formula $R^1O[CH_2CH_2O]_x[CH_2CH(R^3)O]_yCH_2CH(OH)R^2$, in which $R^1$ and $R^2$ represent, independently of one another, a linear or branched, saturated or mono or polyunsaturated hydrocarbon functional group having 2 to 26 carbon atoms, $R^3$ is selected, independently of one another, from —$CH_3$, —$CH_2CH_3$, —$CH_2CH_2$—$CH_3$, —$CH(CH_3)_2$, but preferably represents —$CH_3$, and x and y represent, independently of one another, values of between 1 and 32, nonionic surfactants where $R^3$=—$CH_3$ and having values for x of from 15 to 32 and for y of 0.5 and 1.5 being very particularly preferred.

Further nonionic surfactants that can preferably be used are the end-capped poly(oxyalkylated) nonionic surfactants of the formula $R^1O[CH_2CH(R^3)O]_x[CH_2]_kCH(OH)[CH_2]_jOR^2$, in which $R^1$ and $R^2$ represent linear or branched, saturated or unsaturated, aliphatic or aromatic hydrocarbon functional groups having 1 to 30 carbon atoms, $R^3$ represents H or a methyl, ethyl, n-propyl, iso-propyl, n-butyl, 2-butyl or 2-methyl-2-butyl functional group, x represents values of between 1 and 30, and k and j represent values of between 1 and 12, preferably between 1 and 5. If the value x is >2, every $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon functional groups having 6 to 22 carbon atoms, with functional groups having 8 to 18 C atoms being particularly preferred. —H, —$CH_3$ or —$CH_2CH_3$ are particularly preferred for the functional group $R^3$. Particularly preferred values for x are in the range of from 1 to 20, in particular from 6 to 15.

As described above, every $R^3$ in the above formula can be different if x is >2. In this way, the alkylene oxide unit in square brackets can be varied. For example, if x represents 3, the functional group $R^3$ can be selected in order to form ethylene oxide ($R^3$=H) or propylene oxide ($R^3$=$CH_3$) units, which can be joined together in any sequence, for example (EO)(PO)(EO), (EO)(EO)(PO), (EO)(EO)(EO), (PO)(EO)(PO), (PO)(PO)(EO), and (PO)(PO)(PO). The value 3 for x has been selected here for the sake of example and can by all means be greater, in which case the range of variation increases as the values for x increase and includes a large number of (EO) groups combined with a small number of (PO) groups, for example, or vice versa.

Particularly preferred end-capped poly(oxyalkylated) alcohols of the above formula have values of k=1 and j=1, so that the previous formula is simplified to $R^1O[CH_2CH$ $(R^3)O]_xCH_2CH(OH)CH_2OR^2$. In the formula mentioned last, $R^1$, $R^2$ and $R^3$ are as defined above and x represents numbers from 1 to 30, preferably from 1 to 20, and in particular from 6 to 18. Surfactants in which the functional groups $R^1$ and $R^2$ have 9 to 14 C atoms, $R^3$ represents H, and x assumes values of from 6 to 15 are particularly preferred. Finally, the nonionic surfactants of the general formula $R^1$—$CH(OH)CH_2O$—$(AO)_w$-$R^2$ have been found to be particularly effective, in which

- $R^1$ represents a straight-chain or branched, saturated or mono or polyunsaturated C6-24 alkyl or alkenyl functional group;
- $R^2$ represents a linear or branched hydrocarbon functional group having 2 to 26 carbon atoms;
- A represents a functional group from the group $CH_2CH_2$, $CH_2CH_2CH_2$, $CH_2CH(CH_3)$, preferably $CH_2CH_2$, and
- w represents values of between 1 and 120, preferably 10 to 80, in particular 20 to 40.

The group of these nonionic surfactants includes, for example, $C_{4-22}$ fatty alcohol-$(EO)_{10-80}$-2-hydroxyalkyl ethers, in particular also $C_{8-12}$ fatty alcohol-$(EO)_{22}$-2-hydroxydecyl ethers and $C_{4-22}$ fatty alcohol-$(EO)_{40-80}$-2-hydroxyalkyl ethers.

Preferably, the at least one first and/or the at least one second phase contains at least one nonionic surfactant, preferably a nonionic surfactant from the group of the hydroxy mixed ethers, with the proportion by weight of the nonionic surfactant in terms of the total weight of the second phase being preferably from 0.5 wt. % to 30 wt. %, preferably from 5 wt. % to 25 wt. %, and in particular from 10 wt. % to 20 wt. %.

In another preferred embodiment, the nonionic surfactant of the first and/or second phase is selected from nonionic surfactants of the general formula $R^1$—$O(CH_2CH_2O)_xCR^3R^4(OCH_2CH_2)_yO$—$R^2$, in which $R^1$ and $R^2$ represent, independently of one another, an alkyl functional group or alkenyl functional group having 4 to 22 carbon atoms; $R^3$ and $R^4$ represent, independently of one another, H or an alkyl functional group or alkenyl functional group having 1 to 18 carbon atoms, and x and y represent, independently of one another, values of between 1 and 40.

Compounds of the general formula $R^1$—$O(CH_2CH_2O)_xCR^3R^4(OCH_2CH_2)_yO$—$R^2$ in which $R^3$ and $R^4$ represent H and the indices x and y assume, independently of one another, values of from 1 to 40, preferably from 1 to 15, are preferred. Compounds of the general formula $R^1$—$O(CH_2CH_2O)_xCR^3R^4(OCH_2CH_2)_yO$—$R^2$ in which the functional groups $R^1$ and $R^2$ represent, independently of one another, saturated alkyl functional groups having 4 to 14 carbon atoms, and the indices x and y assume, independently of one another, values of from 1 to 15, and in particular from 1 to 12, are particularly preferred. Compounds of the general formula $R^1$—$O(CH_2CH_2O)_xCR^3R^4(OCH_2CH_2)_yO$—$R^2$ in which one of the functional groups $R^1$ and $R^2$ is branched are also preferred. Compounds of the general formula $R^1$—$O(CH_2CH_2O)_xCR^3R^4(OCH_2CH_2)_yO$—$R^2$ in which the indices x and y assume, independently of one another, values of from 8 to 12 are very particularly preferred.

The indicated C chain lengths and degrees of ethoxylation and alkoxylation of the nonionic surfactants represent statistical averages that can correspond to an integer or a fractional number for a specific product. Owing to the production methods, commercial products of the above-mentioned formulas generally do not consist of an individual representative, but of mixtures, for which reason average values and, resulting from those, fractional numbers can arise both for the C chain lengths and for the degrees of ethoxylation and alkoxylation.

As will readily be understood, the aforementioned nonionic surfactants can be used not only as individual substances but also as surfactant mixtures of two, three, four, or more surfactants.

In the at least one first phase, nonionic surfactants which have a melting point above room temperature are particularly preferred. Nonionic surfactant(s) having a melting point above 20° C., preferably above 25° C., particularly preferably between 25 and 60° C., and in particular between 26.6 and 43.3° C., is/are particularly preferred.

Suitable nonionic surfactants having melting or softening points in the mentioned temperature range include, for example, low-foaming nonionic surfactants which can be solid or highly viscous at room temperature. If nonionic surfactants which are highly viscous at room temperature are used, they preferably have a viscosity above 20 Pa·s, preferably above 35 Pa·s, and in particular above 40 Pa·s. Nonionic surfactants that have a wax-like consistency at room temperature are also preferred.

The nonionic surfactant that is solid at room temperature preferably has propylene oxide (PO) units in the molecule. Preferably, such PO units account for up to 25 wt. %, particularly preferably up to 20 wt. %, and in particular up to 15 wt. %, of the total molar mass of the nonionic surfactant. Particularly preferred nonionic surfactants are ethoxylated monohydroxy alkanols or alkyl phenols that additionally comprise polyoxyethylene-polyoxypropylene block copolymer units. The alcohol or alkyl phenol portion of nonionic surfactant molecules of this kind preferably account for more than 30 wt. %, particularly preferably more than 50 wt. %, and in particular more than 70 wt. %, of the total molar mass of nonionic surfactants of this kind. Preferred agents are characterized in that they contain ethoxylated and propoxylated nonionic surfactants in which the propylene oxide units in the molecule account for up to 25 wt. %, preferably up to 20 wt. %, and in particular up to 15 wt. %, of the total molar mass of the nonionic surfactant.

Additional particularly preferred nonionic surfactants to be used in the first phase that have melting points above room temperature contain 40 to 70% of a polyoxypropylene/polyoxyethylene/polyoxypropylene block polymer blend that contains 75 wt. % of a reverse block copolymer of polyoxyethylene and polyoxypropylene having 17 mols of ethylene oxide and 44 mols of propylene oxide and 25 wt. % of a block copolymer of polyoxyethylene and polyoxypropylene, initiated with trimethylolpropane and containing 24 mols of ethylene oxide and 99 mols of propylene oxide per mol of trimethylolpropane.

In one preferred embodiment, the proportion by weight of the nonionic surfactant in terms of the total weight of the first phase is from 0.1 to 20 wt. %, particularly preferably from 0.5 to 15 wt. %, in particular from 2.5 to 10 wt. %.

All anionic surface-active substances are suitable for use as anionic surfactants in the dishwashing detergents. These are characterized by a water-solubilizing, anionic group such as a carboxylate, sulfate, sulfonate or phosphate group and a lipophilic alkyl group having approximately 8 to 30 C atoms. In addition, glycol or polyglycol ether groups, ester, ether and amide groups, and hydroxyl groups may be contained in the molecule. Suitable anionic surfactants are preferably present in the form of the sodium, potassium and ammonium as well as mono, di and trialkanol ammonium salts having 2 to 4 C atoms in the alkanol group, but zinc, manganese(II), magnesium, calcium, or mixtures thereof can also be used as counterions.

Preferred anionic surfactants are alkyl sulfates, alkyl polyglycol ether sulfates, and ether carboxylic acids having 10 to 18 C atoms in the alkyl group and up to 12 glycol ether groups in the molecule.

Instead of the above-mentioned surfactants or in conjunction with them, cationic and/or amphoteric surfactants such as betaines or quaternary ammonium compounds can also be used. It is preferred, however, that no cationic and/or amphoteric surfactants be used.

Surfactants influence the opacity of the second phase. In a likewise preferred, different embodiment, the at least one second phase (2) is therefore free of surfactants, in particular of nonionic surfactants.

Preferred detergent or cleaning agents according to the invention are also characterized in that, in the at least one first and/or the at least one second phase, in particular in the first phase, they contain less than 1.0 wt. % and in particular no anionic surfactant, since the addition of anionic surfactants has proven disadvantageous with respect to the phase characteristics, in particular the hardness, friability (wearing behavior), and post-curing behavior.

Substances that are also used as ingredients of cosmetic agents are also designated in the following according to the International Nomenclature Cosmetic Ingredients (INCI) as appropriate. Chemical compounds have an INCI name in English. The INCI names can be found in the "International Cosmetic Ingredient Dictionary and Handbook, 7th Edition (1997)," which is published by The Cosmetic, Toiletry and Fragrance Association (CTFA), Washington D.C. (USA). The expression CAS means that the following numerical sequence is a designation of the Chemical Abstracts Service.

In addition to the surfactants, the at least one second phase (2) can also comprise sugars. According to the invention, sugars include monosaccharides, disaccharides, and oligosaccharides. Preferably, the second phase comprises disaccharides, particularly saccharose. The proportion of saccharose is from 0 wt. % to 30 wt. %, in particular from 5 wt. % to 25 wt. %, particularly preferably from 10 wt. % to 20 wt. %, based on the weight of the second phase. In higher amounts, the sugar does not dissolve completely in the second phase and results in the clouding thereof. By using sugar, in particular in a proportion of from 10 wt. % to 15 wt. %, the development of moisture is reduced and the adhesion to the at least one first phase thus improved.

The use of builder substances (builders) such as silicates, aluminum silicates (in particular zeolites), salts of organic di and polycarboxylic acids, as well as mixtures of these substances, preferably water-soluble builder substances, can be advantageous.

In an embodiment that is preferred according to the invention, the use of phosphates (including polyphosphates) is omitted either largely or completely. In this embodiment, the agent preferably contains, in the at least one first and/or the at least one second phase, in particular in the at least one first and the at least one second phase, less than 5 wt. %, particularly preferably less than 3 wt. %, in particular less than 1 wt. %, of phosphate(s). Particularly preferably, the agent in this embodiment is completely phosphate-free, i.e., the agents contain less than 0.1 wt. % phosphate(s).

The builders include, in particular, carbonates, citrates, phosphonates, organic builders, and silicates. The proportion by weight of the total builders in terms of the total weight of agents according to the invention is preferably from 15 to 80 wt. % and in particular from 20 to 70 wt. %. Said builders are preferably contained in the at least one first phase.

Some examples of organic builders that are suitable according to the invention are the polycarboxylic acids (polycarboxylates) that can be used in the form of their sodium salts, with polycarboxylic acids being understood to be those carboxylic acids that carry more than one, in particular two to eight, acid functions, preferably two to six, in particular two, three, four, or five acid functions in the entire molecule. Dicarboxylic acids, tricarboxylic acids, tetracarboxylic acids, and pentacarboxylic acids, in particular di, tri, and tetracarboxylic acids, are thus preferred as polycarboxylic acids. The polycarboxylic acids can also carry additional functional groups, such as hydroxyl or amino groups. For example, these include citric acid, adipic acid, succinic acid, glutaric acid, malic acid, tartaric acid, maleic acid, fumaric acid, saccharic acids (preferably aldaric acids, for example galactaric acid and glucaric acid), aminocarboxylic acid, in particular aminodicarboxylic acids, aminotricarboxylic acids, aminotetracarboxylic acids such as nitrilotriacetic acid (NTA), glutamic-N,N-diacetic acid (also called N,N-bis(carboxymethyl)-L-glutamic acid or GLDA), methyl glycine diacetic acid (MGDA) and derivatives thereof and mixtures thereof. Preferred salts are the salts of polycarboxylic acids such as citric acid, adipic acid, succinic acid, glutaric acid, tartaric acid, GLDA, MGDA and mixtures thereof Other substances that are suitable as organic builders are polymeric polycarboxylates (organic polymers having a plurality of (in particular more than ten) carboxylate functions in the macromolecule), polyaspartates, polyacetals, and dextrins.

In addition to their builder effect, the free acids typically also have the property of being an acidification component. Particularly noteworthy here are citric acid, succinic acid, glutaric acid, adipic acid, gluconic acid, and any mixtures thereof Particularly preferred detergents or cleaning agents according to the invention, in particular dishwashing detergents, preferably automatic dishwashing detergents, contain one or more salts of citric acid, i.e., citrates, as one of their essential builders.

These are preferably contained in a proportion of from 2 to 40 wt. %, in particular from 5 to 30 wt. %, more particularly from 7 to 28 wt. %, particularly preferably from 10 to 25 wt. %, very particularly preferably from 15 to 20 wt. %, in each case based on the total weight of the agent.

It is also particularly preferable to use carbonate(s) and/or hydrogen carbonate(s), preferably alkali carbonate(s), particularly preferably sodium carbonate (soda), in amounts of from 2 to 50 wt. %, preferably from 4 to 40 wt. %, and in particular from 10 to 30 wt. %, very particularly preferably from 10 to 24 wt. %, in each case based on the weight of the agent.

Particularly preferred detergents or cleaning agents according to the invention, in particular dishwashing detergents, preferably automatic dishwashing detergents, are characterized in that they contain at least two builders from the group of silicates, phosphonates, carbonates, aminocarboxylic acids, and citrates, with the proportion by weight of these builders, based on the total weight of the cleaning agent according to the invention, being preferably from 5 to 70 wt. %, more preferably from 15 to 60 wt. %, and in particular from 20 to 50 wt. %. The combination of two or more builders from the above-mentioned group has been found to be advantageous for the cleaning and rinsing performance of detergents or cleaning agents according to the invention, in particular dishwashing detergents, preferably automatic dishwashing detergents. Beyond the builders mentioned here, one or more other builders can be additionally contained.

Preferred detergents or cleaning agents, in particular dishwashing detergents, preferably automatic dishwashing detergents, are characterized by a builder combination of citrate and carbonate and/or hydrogen carbonate. In one embodiment that is very particularly preferred according to the invention, a mixture of carbonate and citrate is used in which the amount of carbonate is preferably from 5 to 40 wt. %, in particular from 10 to 35 wt. %, very particularly preferably from 15 to 30 wt. %, and the amount of citrate is preferably from 5 to 35 wt. %, in particular from 10 to 25 wt. %, very particularly preferably from 15 to 20 wt. %, in each case based on the total amount of the cleaning agent, with the total amount of these two builders preferably being from 20 to 65 wt. %, in particular from 25 to 60 wt. %, preferably from 30 to 50 wt. %. Moreover, one or more other builders can be additionally contained.

The detergents or cleaning agents according to the invention, in particular dishwashing detergents, preferably automatic dishwashing detergents, can contain phosphonates in particular as an additional builder. A hydroxyalkane and/or aminoalkane phosphonate is preferably used as a phosphonate compound. Among the hydroxyalkane phosphonates, 1-hydroxyethane-1,1-diphosphonate (HEDP) is of particular significance. Possible preferable aminoalkane phosphonates include ethylenediamine tetramethylene phosphonate (EDTMP), diethylentriamine pentamethylene phosphonate (DTPMP) and the higher homologues thereof. Phosphonates are preferably contained in agents according to the invention in amounts of from 0.1 to 10 wt. %, in particular in amounts of from 0.5 to 8 wt. %, very particularly preferably in amounts of from 2.5 to 7.5 wt. %, in each case based on the total weight of the agent.

The combined use of citrate, (hydrogen) carbonate, and phosphonate is particularly preferred. These can be used in the above-mentioned amounts. In particular, amounts of from 10 to 25 wt. % citrate, 10 to 30 wt. % carbonate (or hydrogen carbonate), and 2.5 to 7.5 wt. % phosphonate are used in this combination, in each case based on the total weight of the agent.

Further particularly preferred detergents or cleaning agents, in particular dishwashing detergents, preferably automatic dishwashing detergents, are characterized in that they contain, in addition to citrate and (hydrogen) carbonate and optionally phosphonate, at least one additional phosphorous-free builder. In particular, said builder is selected from the aminocarboxylic acids, with the additional phosphorous-free builder preferably being selected from methyl glycine diacetic acid (MGDA), glutamic acid diacetate (GLDA), aspartic acid diacetate (ASDA), hydroxyethyliminodiacetate (HEIDA), iminodisuccinate (IDS), and ethylenediamine disuccinate (EDDS), particularly preferably from MGDA or GLDA. An example of a particularly preferred combination is citrate, (hydrogen) carbonate, and MGDA as well as, optionally, phosphonate.

The proportion by weight of the additional phosphorous-free builder, in particular of the MGDA and/or GLDA, is preferably from 0 to 40 wt. %, in particular from 5 to 30 wt. %, more particularly from 7 to 25 wt. %. The use of MGDA or GLDA, in particular MGDA, as a granulate is particularly preferred. Advantageous in this regard are MGDA granulates that contain as little water as possible and/or have a lower hygroscopicity (water absorption at 25° C., normal pressure) than non-granulated powders. The combination of at least three, in particular at least four, builders from the above-mentioned group has been found to be advantageous for the cleaning and rinsing performance of cleaning agents according to the invention, in particular dishwashing detergents, preferably automatic dishwashing detergents. Besides those, additional builders can also be contained.

Polymeric polycarboxylates are also suitable as organic builders. These are, for example, the alkali metal salts of polyacrylic acid or of polymethacrylic acid, for example those having a relative molecular mass of from 500 to 70,000 g/mol. Suitable polymers are in particular polyacrylates which preferably have a molecular mass of from 1,000 to 20,000 g/mol. Due to their superior solubility, the short-chain polyacrylates, which have molar masses from 1,100 to 10,000 g/mol, and particularly preferably from 1,200 to 5,000 g/mol, can be preferred from this group.

The (homo)polymeric polycarboxylates contained in the detergents or cleaning agents according to the invention, in particular dishwashing detergents, preferably automatic dishwashing detergents, are preferably from 0.5 to 20 wt. %, more preferably from 2 to 15 wt. %, and in particular from 4 to 10 wt. %.

Detergents or cleaning agents according to the invention, in particular dishwashing detergents, preferably automatic dishwashing detergents, can also contain, as a builder, crystalline layered silicates of the general formula $NaMSi_xO_{2x+1}.y\ H_2O$, where M represents sodium or hydrogen, x is a number from 1.9 to 22, preferably from 1.9 to 4, with 2, 3, or 4 being particularly preferred values for x, and y represents a number from 0 to 33, preferably from 0 to 20. Amorphous sodium silicates which have a $Na_2O:SiO_2$ modulus of from 1:2 to 1:3.3, preferably from 1:2 to 1:2.8, and in particular from 1:2 to 1:2.6, can also be used which preferably exhibit retarded dissolution and secondary washing properties.

In specific detergents or cleaning agents according to the invention, in particular dishwashing detergents, preferably automatic dishwashing detergents, the silicate content, based on the total weight of the detergent or cleaning agent is limited to amounts of below 10 wt. %, preferably below 5 wt. %, and in particular below 2 wt. %.

In addition to the aforementioned builders, the detergents or cleaning agents according to the invention can also contain alkali metal hydroxides. These alkali carriers are preferably used in the detergents or cleaning agents, and in particular in the at least one second phase, only in small amounts, preferably in amounts of less than 10 wt. %, preferably less than 6 wt. %, more preferably less than 5 wt. %, particularly preferably between 0.1 and 5 wt. %, and in particular between 0.5 and 5 wt. %, in each case based on the total weight of the detergent or cleaning agent. Alternative detergents or cleaning agents according to the invention are free of alkali metal hydroxides.

As an additional component, cleaning agents according to the invention preferably contain enzyme(s) in the at least one first and/or the at least one second phase. These include, in particular, proteases, amylases, lipases, hemicellulases, cellulases, perhydrolases, or oxidoreductases, as well as, preferably, mixtures thereof. These enzymes are in principle of natural origin; starting from the natural molecules, variants that have been improved for use in cleaning agents are available, which are preferably used accordingly. Cleaning agents according to the invention preferably contain enzymes in total amounts of from $1\times10^{-6}$ wt. % to 5 wt. %, based on the active protein. The protein concentration can be determined using known methods, for example the BCA method or the Biuret method.

Among the proteases, subtilisin-type proteases are preferred. Examples of these are the subtilisins BPN' and Carlsberg and the developed forms thereof, protease PB92, subtilisins 147 and 309, the alkaline protease from Bacillus lentus, subtilisin DY, and the enzymes thermitase, proteinase K and proteases TW3 and TW7, which belong to the subtilases but no longer to the subtilisins in the narrower sense.

Examples of amylases that can be used according to the invention are α-amylases from *Bacillus licheniformis*, from β. *amyloliquefaciens*, from β. *stearothermophilus*, from *Aspergillus niger*, and *A. oryzae*, as well as the developments of said amylases that have been improved for use in cleaning agents. Furthermore, the α-amylase from *Bacillus sp.* A 7-7 (DSM 12368) and the cyclodextrin glucanotransferase (CGTase) from β. *agaradherens* (DSM 9948) should be highlighted for this purpose.

Furthermore, lipases or cutinases can be used according to the invention, particularly due to their triglyceride-cleaving activities, but also in order to produce peracids in situ from suitable precursors. These include, for example, the lipases that can originally be obtained from Humicola lanuginosa (Thermomyces lanuginosus) and those that have been developed, in particular those with the amino acid exchange in the positions D96LT213R and/or N233R, particularly preferably all of the exchanges D96L, T213R and N233R.

Furthermore, enzymes may be used which can be grouped together under the term "hemicellulases". These include, for example, mannanases, xanthan lyases, pectin lyases (=pectinases), pectinesterases, pectate lyases, xyloglucanases (=xylanases), pullulanases, and β-glucanases.

In order to increase the bleaching effect, oxidoreductases such as oxidases, oxygenases, catalases, peroxidases such as halo, chloro, bromo, lignin, glucose, or manganese peroxidases, dioxygenases or laccases (phenoloxidases, polyphenoloxidases) can be used according to the invention. Advantageously, organic, particularly preferably aromatic, compounds that interact with the enzymes are additionally added in order to enhance the activity of the relevant oxidoreductases (enhancers) or, in the event of greatly differing redox potentials, to ensure the flow of electrons between the oxidizing enzymes and the contaminants (mediators). A protein and/or enzyme can be protected, in particular during storage, against damage, for example inactivation, denaturing, or decomposition caused, for example, by physical influences, oxidation, or proteolytic cleavage. When the proteins and/or enzymes are obtained microbially, it is particularly preferable for proteolysis to be inhibited, particularly if the agents also contain proteases. Cleaning agents can contain for this purpose stabilizers; the provision of agents of this kind constitutes a preferred embodiment of the present invention.

Cleaning-active proteases and amylases are generally not made available in the form of the pure protein, but rather in the form of stabilized, storable and transportable preparations. These ready-made preparations include, for example, the solid preparations obtained by means of granulation, extrusion or lyophilization or, particularly in the case of liquid or gel agents, solutions of the enzymes which are advantageously maximally concentrated, have a low water content, and/or are supplemented with stabilizers or other auxiliary agents.

Alternatively, for the at least one first and/or the at least one second phase, the enzymes can be encapsulated, for example by means of spray-drying or extrusion of the enzyme solution together with a preferably natural polymer or in the form of capsules, for example those in which the enzymes are enclosed in a set gel, or in those of the core-shell type in which an enzyme-containing core is coated with a water, air, and/or chemical-impermeable protective layer. In the case of overlaid layers, other active ingredients, such as stabilizers, emulsifiers, pigments, bleaching agents, or dyes, can be additionally applied. Capsules of this kind are applied using inherently known methods, for example by means of shaking or roll granulation or in fluidized bed processes. Granulates of this kind are advantageously low in dust, for example due to the application of polymeric film-formers, and stable in storage due to the coating.

Moreover, it is possible to formulate two or more enzymes together, so that a single granulate has several enzyme activities.

As can be seen from the preceding remarks, the enzyme protein forms only a fraction of the total weight of conventional enzyme preparations. Protease and amylase preparations that are preferably used according to the invention contain between 0.1 and 40 wt. %, preferably between 0.2 and 30 wt. %, particularly preferably between 0.4 and 20 wt. %, and in particular between 0.8 and 10 wt. %, of the enzyme protein. In particular, those cleaning agents are preferred which contain, based on their total weight, from 0.1 to 12 wt. %, preferably from 0.2 to 10 wt. %, and in particular 0.5 to 8 wt. % ,of the respective enzyme preparations.

In addition to the components mentioned previously, the at least one first and/or the at least one second phase of the detergent or cleaning agent according to the invention can contain additional ingredients. For example, these include anionic, cationic, and/or amphoteric surfactants, bleaching agents, bleach activators, bleach catalysts, other solvents, thickeners, sequestering agents, electrolytes, corrosion inhibitors, in particular silver protecting agents, glass corrosion inhibitors, foam inhibitors, dyes, fragrances (in particular in the at least one phase), additives for improving flow and drying behavior, for adjusting viscosity or for stabilization, UV stabilizers, pearlescers (INCI Opacifying Agents; for example glycol distearate, such as Cutina® AGS from Cognis, or mixtures containing same, such as Euperlane® from Cognis), preservatives (for example, the industrial preservative 2-bromo-2-nitropropane-1,3-diol, which is also known as Bronopol (CAS 52-51-7) and is commercially available as Myacide® BT or as Boots Bronopol BT from Boots), antimicrobial active ingredients (disinfectants), and pH adjusters in amounts of usually no more than 5 wt. %.

Agents according to the invention preferably contain at least one alkanolamine as an additional solvent. The alkanolamine is preferably selected from the group consisting of mono, di, triethanol and propanolamine and mixtures thereof. The alkanolamine is preferably contained in agents according to the invention in an amount of from 0.5 to 10 wt. %, in particular in an amount of from 1 to 6 wt. %. In a preferred detergent or cleaning agent, the at least one second phase is free of alkanolamine, and the alkanolamine is contained only in the at least one first phase.

In a preferred embodiment, detergents or cleaning agents according to the invention, in particular dishwashing detergents, contain, as an additional component, at least one zinc salt as a glass corrosion inhibitor. The zinc salt can be an inorganic or organic zinc salt. The zinc salt to be used according to the invention preferably has a solubility in water of above 100 mg/l, preferably above 500 mg/l, particularly preferably above 1 g/l, and in particular above 5 g/l (all solubilities at 20° C. water temperature). The inorganic zinc salt is preferably selected from the group consisting of zinc bromide, zinc chloride, zinc iodide, zinc nitrate, and zinc sulfate. The organic zinc salt is preferably selected from the group consisting of zinc salts of monomeric or polymeric organic acids, in particular from the group of zinc acetate, zinc acetyl acetonate, zinc benzoate, zinc formiate, zinc lactate, zinc gluconate, zinc ricinoleate, zinc abietate, zinc valerate, and zinc-p-toluene sulfonate. In an embodiment that is particularly preferred according to the invention, zinc acetate is used as the zinc salt. The zinc salt is contained in cleaning agents according to the invention preferably in an amount of from 0.01 wt. % to 5 wt. %, particularly preferably in an amount of from 0.05 wt. % to 3 wt. %, in particular in an amount of from 0.1 wt. % to 2 wt. %, based on the total weight of the cleaning agent. In addition to or as an alternative to the above-mentioned salts (in particular the zinc salts), polyethyleneimines such as those which are available under the name Lupasol® (BASF) can preferably be used as glass corrosion inhibitors in an amount of from 0 to 5 wt. %, in particular from 0.01 to 2 wt. %.

Polymers that are suitable as additives are in particular maleic acid acrylic acid copolymer Na salt (for example Sokalan® CP 5 from BASF, Ludwigshafen (Germany)), modified polyacrylic acid Na salt (for example, Sokalan® CP 10 from BASF, Ludwigshafen (Germany)), modified polycarboxylate Na salt (for example Sokalan® HP 25 from BASF, Ludwigshafen (Germany)), polyalkylene oxide, modified heptamethyltrisiloxane (for example Silwet® L-77 from BASF, Ludwigshafen (Germany)), polyalkylene oxide, modified heptamethyltrisiloxane (for example Silwet® L-7608 from BASF, Ludwigshafen (Germany)), as well as polyether siloxanes (copolymers of polymethyl siloxanes with ethylene oxide/propylene oxide segments (polyether blocks)), preferably water-soluble, linear polyether siloxanes with terminal polyether blocks, such as Tegopren® 5840, Tegopren® 5843, Tegopren® 5847, Tegopren® 5851, Tegopren® 5863, or Tegopren® 5878 from Evonik, Essen (Germany). Builder substances that are suitable as additives are in particular polyaspartic acid Na salt, ethylenediamine triacetate cocoalkyl acetamide (for example Rewopol® CHT 12 from Evonik, Essen (Germany)), methyl glycine diacetic acid tri-Na salt, and acetophosphonic acid. In the case of Tegopren® 5843 and Tegopren® 5863, mixtures with surfactant or polymeric additives exhibit synergisms. However, the use of Tegopren types 5843 and 5863 on hard surfaces made of glass, in particular glass dishes, is less preferred, since these silicone surfactants can adhere to glass. In a special embodiment of the invention, the above-mentioned additives are omitted.

A preferred detergent or cleaning agent, in particular dishwashing detergent, preferably also comprises a bleaching agent, in particular an oxygen bleaching agent, and, optionally, a bleach activator and/or bleach catalyst. If present, they are contained exclusively in the at least one first phase.

As a preferred bleaching agent, cleaning agents according to the invention contain an oxygen bleaching agent from the group of sodium percarbonate, sodium perborate tetrahydrate, and sodium perborate monohydrate. Some other examples of suitable bleaching agents are peroxypyrophosphates, citrate perhydrates, and H202-yielding peracidic salts or peracids, such as perbenzoates, peroxophthalates, diperazelaic acid, phthaloiminoperacid, or diperdodecane diacid. Moreover, bleaching agents from the group of organic bleaching agents can also be used. Typical organic bleaching agents are diacyl peroxides, such as dibenzoyl peroxide. Other typical organic bleaching agents are peroxy acids, with particular mention of alkylperoxy acids and arylperoxy acids as examples. Due to its good bleaching performance, sodium percarbonate is particularly preferred. One particularly preferred oxygen bleaching agent is sodium percarbonate.

Compounds which, under perhydrolysis conditions, result in aliphatic peroxocarboxylic acids having preferably 1 to 10 C atoms, in particular 2 to 4 C atoms, and/or optionally substituted perbenzoic acid, may be used as bleach activators. Substances that carry 0 and/or N acyl groups having the indicated number of C atoms and/or optionally substituted benzoyl groups are suitable. Polyacylated alkylene diamines are preferred, with tetraacetylethylenediamine (TAED) having been found to be particularly suitable.

The bleach catalysts are bleach-enhancing transition metal salts or transition metal complexes such as Mn, Fe, Co, Ru, or Mo salene complexes or carbonyl complexes. Mn, Fe, Co, Ru, Mo, Ti, V, and Cu complexes with N-containing tripod ligands as well as Co, Fe, Cu, and Ru ammine complexes can also be used as bleach catalysts. Complexes of manganese in oxidation stage II, III, IV, or IV are particularly preferably used which preferably contain one or more macrocyclic ligands having the donor functions N, NR, PR, O and/or S. Preferably, ligands are used which have nitrogen donor functions. It is particularly preferable to use bleach catalyst(s) in the agents according to the invention which contain(s), as a macromolecular ligand, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1-1,4,7-trimethyl-1,4,7-triazacyclononane (Me/Me-TACN), and/or 2-methyl-1,4,7-triazacyclononane (Me/TACN). Suitable manganese complexes are for example $[Mn^{III}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}_4(\mu\text{-}O)_6(TACN)_4](ClO_4)_4$, $[Mn^{III}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}_2(\mu\text{-}O)_3(Me\text{-}TACN)_2](PF_6)_2$ and $[Mn^{IV}_2(\mu\text{-}O)_3(Me/Me\text{-}TACN)_2](PF_6)_2$ (where OAc=OC(O)$CH_3$).

When benzoic acid, salicylic acid, or lactic acid are used as pH regulators and/or buffer substances, these compounds can support or boost the antibacterial effect of the silver and/or of the silver compound.

The detergent or cleaning agent according to the invention comprises at least one first phase (1) and at least one second phase (2). The detergent or cleaning agent can thus have one, two, three, or more different first phases (1); likewise, it can have one, two, three, or more different second phases (2). Preferably, the detergent or cleaning agent according to the invention comprises one first phase (1) and one second phase (2). Particularly preferably, the detergent or cleaning agent comprises two first phases (1) and one second phase (2). More preferably, it comprises two first phases (1) and two second phases (2). An embodiment is also preferred in which the detergent or cleaning agent comprises three first phases (1) and one or two second phases (2). In this case, the weight ratio of the at least one first phase (1) to the at least one second phase (2) is preferably from 20:1 to 8:1. The total weight of phase (1) in a cleaning agent portion can be between 8 and 30 g, particularly from 10 to 25 g, preferably from 12 to 21 g, for example from 14 to 19 g. This weight ratio provides a good concentration of the respective ingredients of the first (1) and second phase (2) in a cleaning procedure. FIGS. 1 to 4 schematically show different arrangements, without this having a limiting effect.

According to the invention, the at least one first phase (1) and the at least one second phase (2) are adjacent to one another over all or part of their surfaces. It is preferable in this regard for the two phases to be immediately adjacent. It is also possible, however, for the at least one first phase (1) or the at least one second phase (2) or the at least one first phase (1) and the at least one second phase (2) to be tightly wrapped in a water-soluble film or contained in a water-soluble pouch. Preferably, the entire agent is contained in a water-soluble pouch or, particularly preferably, tightly wrapped in a water-soluble film.

If the at least one first phase (1) and the at least one second phase (2) are immediately adjacent to one another over all or part of their surfaces, stability is important, as is a setting time of the at least one second phase (2) that is as short as possible. Here, stability means that components contained in the second phase do not cross over into the at least one first phase, but rather the at least one first phase and the second phase remain visually separate from one another even after a relatively long period of storage and do not interact with one another, for example through the diffusion of liquid components from one phase to the other or the reaction of components of one phase with those in the other phase, or loss of adhesion of the second phase (2) to the in particular pressed, compacted first phase (1) as a result of the leakage of liquid. Surprisingly, it has been found that this can be made possible by a second phase that comprises glycerin, gelatin, and at least one $C_3$ to $C_5$ alkanediol.

The water-soluble film or the water-soluble pouch preferably comprises a water-soluble polymer. Some preferred water-soluble polymers that are preferably used as water-soluble packaging are polyvinyl alcohols, acetalized polyvinyl alcohols, polyvinyl pyrrolidones, polyethylene oxides, celluloses, and gelatin, with polyvinyl alcohols and acetalized polyvinyl alcohols being particularly preferably used.

"Polyvinyl alcohols" (abbreviated as PVAL, and occasionally as PVOH) is the name for polymers of the general structure

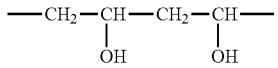

which also contain small proportions (approx. 2%) of structural units of the type

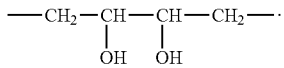

Commercially available polyvinyl alcohols, which are sold as white-yellowish powders or granulates having degrees of polymerization in the range of from approximately 100 to 2,500 (molar masses of from approximately 4,000 to 100,000 g/mol), have degrees of hydrolysis of 87-99 mol. %, so they still contain residual acetyl groups.

In the context of the present invention, it is preferable for the water-soluble packaging to comprise at least some proportion of polyvinyl alcohol of which the degree of hydrolysis is preferably from 70 to 100 mol. %, in particular from 80 to 90 mol. %, particularly preferably from 81 to 89 mol. %, and in particular from 82 to 88 mol. %. In a preferred embodiment, the water-soluble packaging consists of at least 20 wt. %, particularly preferably at least 40 wt. %, very particularly preferably at least 60 wt. %, and in particular at least 80 wt. %, of a polyvinyl alcohol of which the degree of hydrolysis is from 70 to 100 mol. %, preferably from 80 to 90 mol. %, particularly preferably from 81 to 89 mol. %, and in particular from 82 to 88 mol. %.

Preferably, polyvinyl alcohols having a molecular weight within a defined molecular weight range are used as materials for the packaging, with it being preferable according to the invention for the packaging material to comprise a polyvinyl alcohol of which the molecular weight is in the range of from 5,000 $g \cdot mol^{-1}$ to 100,000 $g \cdot mol^{-1}$, preferably from 10,000 $g \cdot mol^{-1}$ to 90,000 $g \cdot mol^{-1}$, particularly preferably from 12,000 $g \cdot mol^{-1}$ to 80,000 $g \cdot mol^{-1}$, and in particular from 15,000 $g \cdot mol^{-1}$ to 70,000 $g \cdot mol^{-1}$.

The degree of polymerization of such preferred polyvinyl alcohols is from approximately 200 to approximately 2,100, preferably from approximately 220 to approximately 1,890, particularly preferably from approximately 240 to approximately 1,680, and in particular from approximately 260 to approximately 1,500.

The water solubility of polyvinyl alcohol can be altered by means of post-treatment with aldehydes (acetalization) or ketones (ketalization). Polyvinyl alcohols which are acetalized or ketalized with the aldehyde or keto groups of saccharides or polysaccharides or mixtures thereof have been found to be particularly preferred and particularly advantageous due to their decidedly good solubility in cold water. It is extremely advantageous to use the reaction products from polyvinyl alcohol and starch. Furthermore, the water solubility can be altered and thus set at desired values in a targeted manner by means of complexing with Ni or Cu salts or by means of treatment with dichromates, boric acid, or borax.

The water-soluble pouch preferably has a thickness of from 10 μm to 500 μm, in particular from 20 μm to 400 μm, particularly preferably from 30 μm to 300 μm, above all from 40 μm to 200 μm, in particular from 50 μm to 150 μm. One polyvinyl alcohol that is particularly preferably used is available under the trade name M8630 (Monosol), for example.

The water-soluble film that is preferably used in the tight wrapping particularly preferably comprises polyvinyl alcohol, as described above, with a thickness of from 10 μm to 100 μm, in particular from 12 μm to 60 μm, particularly preferably from 15 μm to 50 μm, above all from 20 μm to 40 μm, in particular from 22 μm to 35 μm, being preferably used as the initial thickness.

In the case of tight wrapping, a single-use portion of the detergent or cleaning agent is wrapped in each case. For the wrapped detergents or cleaning agents according to the invention, it is important that the wrapping rests tightly against the entire surface of the tablets. Ideally, the wrapping is even under tension, but this is not absolutely necessary. This tight abutment of the wrapping is conducive to disintegration: Upon initial contact with water, the wrapping will allow a small amount of water through at some place and does not have to dissolve at all initially. It is there that the disintegrant contained in the tablet begins to swell. As a result, the wrapping now tears open suddenly due to the increase in volume and releases the tablet. In the case of a wrapping that does not abut tightly, the mechanism being described here does not work, since the tablet can swell without the wrapping bursting open. The use of a swellable disintegration agent is superior to a gas-producing system, since its bursting effect always results in the tearing-open of the wrapping. In a gas-producing system, the bursting effect can "fizzle out" due to the leakage of the gas from a leak point in the wrapping.

Single-use portions of detergents or cleaning agents according to the invention are characterized in that the distance between the single-use portion and the water-soluble wrapping over the entire surface is from 0.1 to 1000 μm, preferably from 0.5 to 500 μm, particularly preferably from 1 to 250 μm, and in particular from 2.5 to 100 μm.

In a preferred embodiment, the film wrapping is first placed and welded loosely around a single-use portion of detergent or cleaning agent and then shrunk onto said portion, thus resulting in close contact between the film packaging and the cleaning agent concentrate. Consequently, single-use portions of detergent or cleaning agent according to the invention are characterized in that the wrapping is a film packaging that is shrunk onto said portions.

For example, this wrapping can be produced by placing a water-soluble base film onto a transport chain or a shaping tool, upon which one or more portions of detergent or cleaning agent are placed onto the base film; a water-soluble top film is then placed onto the portion(s) of detergent or cleaning agent, and is then fixed to the base film, thus enclosing the portion(s) of detergent or cleaning agent. Alternatively, this step can also be performed using a single-strand film that is then placed around the single-use portions as a tube. The films are then sealed and, optionally, cut. The film can then be shrunk on by the use of hot air or infrared radiation, optionally with pressing force.

Water-soluble wrappings of this kind have also already been described in patent applications WO 2004/031338 A and WO 2003/099985 A, to the entire disclosure of which reference is hereby made.

In a preferred embodiment, the at least one first phase (1) of the detergent or cleaning agent according to the invention, in particular of the dishwashing detergent, preferably of the automatic dishwashing detergent, is present in the form of a shaped body, in particular a compacted body, more particularly a tablet. Particularly preferably, the at least one first phase (1) is a powdered detergent or cleaning agent that is compacted in the form of a tablet.

Figure 2A:
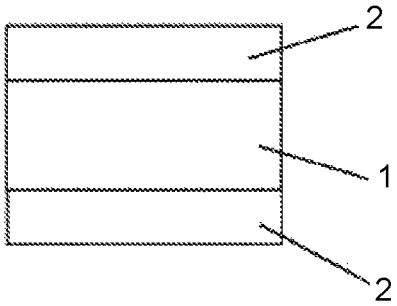
FIGS. 2*a* and 2*b* schematically show another possible arrangement of a first phase surrounded by second phases.
Figure 2B:
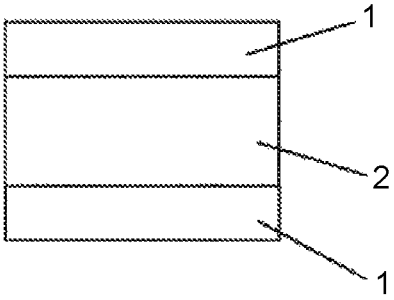
Figure 3A:
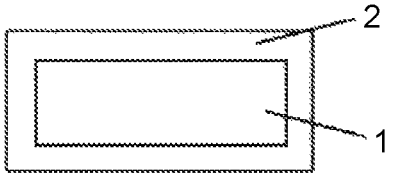
FIGS. 3*a* and 3*b* schematically show a possible arrangement embedding one phase in another phase.
Figure 3B:
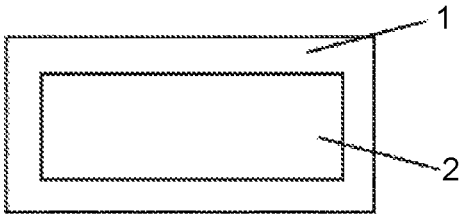
Figure 4:
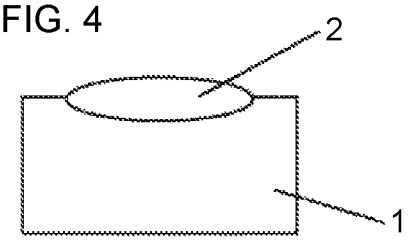
FIG. 4 schematically shows another possible arrangement, in which the second phase is in the form of a core which is embedded in the first phase.

Regardless of whether directly or indirectly (for example, through the presence of a film, wrapping, or pouch as described above), the at least one first phase (1) and the at least one second phase (2) can be arranged in any combination in relation to one another. For instance, a first phase (1) can be arranged on or next to a second phase (2), as shown schematically in FIG. 1. In this embodiment, the detergent or cleaning agent according to the invention comprises one first phase (1) and one second phase (2). It is also conceivable for a first phase (1) to be surrounded by second phases (2), or vice versa, as illustrated in FIGS. 2*a* and 2*b*. The embedding of one phase in another, as is shown schematically in FIGS. 3*a* and 3*b*, is also covered by the invention. Another, particularly preferred arrangement is shown schematically in FIG. 4. In this figure, the second phase (2) is present in the form of a core that is embedded in the first phase (1). A pool shape of the solid first phase (1), i.e. a shape with a depression into which the second phase is introduced, is particularly preferred. The depression can be round, oval, or square. Two depressions that are separate from one another can also be present which are filled with the at least one second phase (2). In this embodiment, the detergent or cleaning agent comprises two second phases (2), it being possible for the two second phases to have different compositions.

In principle, any geometry is possible. The rectangular shape shown here is provided only by way of example. A round or oval shape of the two phases, or any polygonal configuration are also conceivable.

Another object of the present application is a method for cleaning hard surfaces, in particular dishes, in which the surface is processed in an inherently known manner using a cleaning agent according to the invention. In particular, the surface is brought into contact with the detergent or cleaning agent according to the invention. The cleaning is performed in particular using a cleaning machine, preferably a dishwasher.

Another object of the present invention is also the use of a cleaning agent for cleaning hard surfaces, in particular dishes.

In a preferred embodiment, the present application relates to automatic dishwashing detergents. In terms of the present application, automatic dishwashing detergents are compositions that can be used to clean soiled dishes in a mechanical dishwashing process. The automatic dishwashing detergents according to the invention thus differ, for example, from automatic rinse aids which are always used in combination with automatic dishwashing detergents and do not have any cleaning effect of their own.

Insofar as it is stated in the present application that the detergent or cleaning agent according to the invention comprises something as a whole or in the at least one first phase (1) or in the at least one second phase (2), this shall also be regarded as disclosing the fact that detergents or cleaning agents or the relevant phase can consist thereof. In the following practical example, the detergent or cleaning agent according to the invention is described in a non-limiting manner.

Practical Examples:

Cleaning agents according to the invention were prepared which comprised one first phase and one second phase. Different geometries were realized. Moreover, cleaning agents were prepared that comprised two first phases and one second phase. The following values refer to wt. % of active substance based on the total weight of the phase in question.

The first phases had the following composition:

| | Wt. % |
|---|---|
| Citrate, Na salt | 10-25 |
| Phosphonate (e.g., HEDP) | 0-10 |
| MGDA, Na salt | 0-40 |
| Disilicate, Na salt | 0-40 |
| Soda | 10-30 |
| Percarbonate, Na salt | 5.0-20.0 |
| Bleach catalyst (preferably Mn-based) | 0.0-0.8 |
| Bleach activator (e.g., TAED) | 1.0-4.0 |
| Nonionic surfactant(s), e.g., fatty alcohol alkoxylate, preferably 20-40 EO, optionally end-capped | 1.5-15.0 |
| Polycarboxylate | 0.5-15 |
| Cationic copolymer | 0.0-1.0 |
| Disintegrant - (e.g., crosslinked PVP) | 0.0-3.0 |
| Protease preparation (tq) | 1.0-7 |
| Amylase preparation (tq) | 0.2-6 |
| Silver protecting agent (benzotriazole) | 0.0-1.0 |
| Perfume | 0.0-0.5 |
| Dye solution | 0.0-1.5 |
| Zn salt (e.g., acetate) | 0.01-0.5 |
| Sodium sulfate | 0.0-25 |
| Water | 0.0-3 |
| pH adjuster (e.g., citric acid) | 0.0-5 |
| Processing aids | 0-10 |

Moreover, first phases were prepared which had the following composition:

| | Wt. % |
|---|---|
| Citrate, Na salt | 15-20 |
| Phosphonate (e.g., HEDP) | 2.5-7.5 |
| MGDA, Na salt | 0-25 |
| Disilicate, Na salt | 5-35 |
| Soda | 10-25 |
| Percarbonate, Na salt | 10-15 |
| Bleach catalyst (preferably Mn-based) | 0.02-0.5 |
| Bleach activator (e.g., TAED) | 1-3 |
| Nonionic surfactant(s), e.g., fatty alcohol alkoxylate, preferably 20-40 EO, optionally end-capped | 2.5-10 |
| Polycarboxylate | 4-10 |
| Cationic copolymer | 0-0.75 |
| Disintegrant - (e.g., crosslinked PVP) | 0-1.5 |
| Protease preparation (tq) | 1.5-5 |
| Amylase preparation (tq) | 0.5-3 |
| Silver protecting agent (benzotriazole) | 0-0.5 |
| Perfume | 0.05-0.25 |
| Dye solution | 0.0-1 |
| Zn salt (e.g., acetate) | 0.1-0.3 |
| Sodium sulfate | 0.0-10 |
| Water | 0.0-1.5 |
| pH adjuster (e.g., citric acid) | 0-1.5 |
| Processing aids | 0-5 |

These first phases were in the form of a compacted tablet having a recess in one side. A liquid composition was poured into said recess, and the second phase was thereby produced after curing. The obtained cleaning agent was in the form as shown schematically in FIG. 4. There were additional first phases without a recess. Here, a second phase was brought into direct contact with the surface of the first phase, as shown schematically in FIGS. 1 to 3.

The second phases had the following composition:

| | Wt. % |
|---|---|
| Glycerin | 0-20 |
| Propanediol (preferably 1,3-propanediol) | 30-65 |
| Polycarboxylate homo and/or copolymer with sulfonic acid-containing groups | 0-30 |
| Nonionic surfactant(s), e.g., fatty alcohol alkoxylate, preferably 20-40 EO, optionally end-capped | 0-40 |
| Polyethylene glycol avg. Mr 1,000-2,000 | 0-20 |
| Thickener (preferably gelatin or PVA) | 5-50 |
| Processing aids | 0-10 |
| Dye solution | 0.1-1.5 |
| Organic acid (citric anhydrate or monohydrate) | 7-14 |

Additional second phases having the following composition were prepared:

| | Wt. % |
|---|---|
| Glycerin | 0-20 |
| Propanediol (preferably 1,3-propanediol) | 30-65 |
| Polycarboxylate homo and/or copolymer with sulfonic acid-containing groups | 5-20 |
| Nonionic surfactant(s), e.g., fatty alcohol alkoxylate, preferably 20-40 EO, optionally end-capped | 5-25 |
| Polyethylene glycol avg. Mr 1,000-2,000 | 0-8 |
| Thickener (preferably gelatin or PVA) | 10-20 |
| Processing aids | 0-5 |
| Dye solution | 0.0-0.5 |
| Organic acid | 7-10 |

The first and the second phases were able to be combined with one another in any way. The spatial configuration of the second phase, which was liquid after the mixing of the ingredients and dimensionally stable within a setting time of from approximately 10 to 15 minutes, was predetermined by the spatial configuration of the first phase and by molds that are customary in the trade or self-designed. The liquid second phase was introduced into these molds and, after the setting time, the molds were removed without altering the second phase. Unlimited geometries of the second phase were made possible in this way.

TABLE 1

Examples of compositions of a second phase

| Raw material/test | E1 | E2 | E3 | E4 | E5 |
|---|---|---|---|---|---|
| 1,3-propanediol | 55 | 50 | 37.48 | 50 | 39 |
| 2-methyl 2-hydroxymethyl-1,3-propanediol | 0 | 0 | 21.85 | 0 | 0 |
| 2-ethyl-2-hydroxymethyl-1,3-propanediol | 0 | 0 | 0 | 0 | 19 |
| Gelatin | 20 | 28 | 20.98 | 28 | 24 |
| Citric acid anhydrate | 3 | 14 | 10.39 | 14 | 0 |
| Glutaric acid | 0 | 0 | 0 | 0 | 9 |
| 1-hydroxyethane-1,1-diphosphonic acid (Na salt) | 12 | 0 | 2.18 | 2 | 2 |
| Nonionic surfactant-Plurafac LF 220 | 10 | 8 | 2.18 | 8 | 0 |
| Liquid paraffin oil | 0 | 0 | 4.94 | 0 | 0 |
| Paraffin gel (Mp >= 80° C.) | 0 | 0 | 0 | 0 | 5 |

The second phases were combined with first phases as described above. Tablets comprising a depression in one side were produced from first phases. The second phase, still in liquid form, was introduced into this depression, and then set. The obtained cleaning agents had a structure as shown schematically in FIG. 4.

The first and second phases were in direct contact with one another.

All samples E1-E5 exhibited no color changes or other interactions after 3 days of storage at 25° C. All samples were stored in parallel at 40° C. and sampled after 3 days and after 10 days. In test E1, an interaction between the two phases was observed after storage for 3 days. This was reflected in a change in color of both the first and second phases in the region of contact between the two. A corresponding color change was not observed in the second phases E2, E3, E4 and E5 according to the invention.

After 10 days, the visual change in E1 was more pronounced, whereas such a change was not observed in samples E2, E3, E4 and E5 according to the invention. In sample E3, no change in the appearance could be observed even after 32 days.

What is claimed is:

1. A detergent or cleaning agent comprising at least one first phase and at least one second phase that is different therefrom, wherein the at least one first phase is solid and the at least one second phase is in a liquid or gel form comprising at least one alkanediol, at least one polymer and at least one organic acid, wherein the at least one polymer comprises 10 to 50 wt % based on the weight of the at least one second phase of gelatin and 1 to 35 wt % based on the weight of the at least one second phase of sulfopolymer the pH of a 1% solution of the at least one second phase in water at 20° C. being 6 or less.

2. The detergent or cleaning agent according to claim 1, wherein the organic acid has a pKa value from 0 to 8.

3. The detergent or cleaning agent according to claim 1, wherein the organic acid is selected from citric acid anhydrate, citric acid monohydrate, glutaric acid, tartaric acid, glycolic acid, oxalic acid and/or sulfamic acid.

4. The detergent or cleaning agent according to claim 1, wherein the pH is in the range from 1 to 5.

5. The detergent or cleaning agent according to claim 1, wherein the proportion of organic acid is from 5 to 20 wt. % based on the total weight of the at least one second phase.

6. The detergent or cleaning agent according to claim 1, wherein the at least one second phase also comprises at least one polyvalent alcohol.

7. The detergent or cleaning agent according to claim 1, wherein the at least one second phase is substantially water-free.

8. The detergent or cleaning agent according to claim 1, wherein the at least polymer further comprises polyvinyl alcohol.

9. The detergent or cleaning agent according to claim 1, wherein the at least one alkanediol comprises 2-methyl-2-hydroxymethyl-1,3-propanediol and/or 2-ethyl-2-hydroxymethyl-1,3-propanediol.

10. The detergent or cleaning agent according to claim 9, wherein the at least one alkanediol comprises 2-methyl-2-hydroxymethyl-1,3-propanediol.

11. The detergent or cleaning agent according to claim 9, wherein the proportion of 2-methyl-2-hydroxymethyl-1,3-propanediol and/or 2-ethyl-2-hydroxymethyl-1, 3-propanediol is 25 wt. % or less based on the total weight of the at least one second phase.

12. The detergent or cleaning agent according to claim 11, wherein the proportion of 2-methyl-2-hydroxymethyl-1,3-propanediol and/or 2-ethyl-2-hydroxymethyl-1, 3-propanediol is 20 wt. % or less based on the total weight of the at least one second phase.

13. The detergent or cleaning agent according to claim 1, wherein the at least one first phase and/or the at least one second phase comprises at least one surfactant.

14. The detergent or cleaning agent according to claim 1, wherein said detergent or cleaning agent is present in the form of a tablet, the weight ratio of the at least one first phase to the at least one second phase being from 20:1 to 8:1.

15. The detergent or cleaning agent according to claim 1, wherein said detergent or cleaning agent is present in the form of a tablet, the at least one first phase forming a compressed, solid phase having a depression, and the at least one second phase being introduced into said depression.

16. The detergent or cleaning agent according to claim 1, wherein said detergent or cleaning agent is for dishwashing.

17. The detergent or cleaning agent according to claim 1, wherein the at least one first phase is a powder.

* * * * *